US006299271B1

(12) United States Patent
Imai

(10) Patent No.: US 6,299,271 B1
(45) Date of Patent: Oct. 9, 2001

(54) INK DROPLET EJECTION APPARATUS AND INK JET RECORDER

(75) Inventor: Koji Imai, Inuyama (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/281,265

(22) Filed: Mar. 30, 1999

(30) Foreign Application Priority Data

| | | |
|---|---|---|
| Mar. 31, 1998 | (JP) | 10-087524 |
| Apr. 6, 1998 | (JP) | 10-093762 |
| Apr. 6, 1998 | (JP) | 10-093763 |
| Apr. 6, 1998 | (JP) | 10-093764 |
| Apr. 9, 1998 | (JP) | 10-093764 |
| Jan. 28, 1999 | (JP) | 11-019946 |

(51) Int. Cl.[7] ..... B41J 29/38; B41J 2/045
(52) U.S. Cl. ..... 347/9; 347/10; 347/69
(58) Field of Search ..... 347/9, 10, 69

(56) References Cited

U.S. PATENT DOCUMENTS

| | | | |
|---|---|---|---|
| 5,028,936 | 7/1991 | Bartky et al. | 347/69 |
| 5,736,994 | 4/1998 | Takahashi | 347/11 |
| 6,145,949 * | 11/2000 | Takahashi | 347/14 |

FOREIGN PATENT DOCUMENTS

| | | | |
|---|---|---|---|
| 0 827838 A * | 6/1998 | (EP) | B41J/2/21 |
| 63-247051 | 10/1988 | (JP) | B41J/3/04 |
| 9-29960 | 2/1997 | (JP) | B41J/2/045 |
| 9-29961 | 2/1997 | (JP) | B41J/2/045 |
| 9-48112 | 2/1997 | (JP) | B41J/2/01 |
| 10-202858 | 8/1998 | (JP) | B41J/2/045 |

* cited by examiner

*Primary Examiner*—Huan Tran
*Assistant Examiner*—Alfred Dudding
(74) *Attorney, Agent, or Firm*—Oliff & Berridge, PLC

(57) ABSTRACT

An ink droplet ejection apparatus includes a print head having ejection nozzles and three storers store serial ejection data therein and transfer them in order. On the basis of the data output from the storers and transfer data control signals, a transfer data generator makes a logical operation to generate additional pulse data for cancellation of ink pressure wave vibration in order to prevent ink from being ejected or dropped accidentally through the nozzles. The control signals are determined depending on temperature and condition of use.

22 Claims, 25 Drawing Sheets

Fig. 4B

TDC 7 = 1 [A, B, C] = [1, 1, 1]

TDC 6 = 1 [A, B, C] = [1, 1, 0]

TDC 5 = 1 [A, B, C] = [1, 0, 1]

TDC 4 = 1 [A, B, C] = [1, 0, 0]

TDC 3 = 1 [A, B, C] = [0, 1, 1]

TDC 2 = 1 [A, B, C] = [0, 1, 0]

TDC 1 = 1 [A, B, C] = [0, 0, 1]

TDC 0 = 1 [A, B, C] = [0, 0, 0]

INK DROPLET EJECTION APPARATUS AND INK JET RECORDER

BACKGROUND OF THE INVENTION

1. Field of the Invention

The present invention relates to ink droplet ejection apparatus for ejecting ink to form an image on a recording medium.

2. Description of Related Art

Conventional recorders which are easy of multiple gradation and colorization include ink jet recorders. Of these recorders, ink droplet ejection apparatus of the drop-on-demand type, which eject printing ink, are coming into wide use because of high ejection efficiency and low running costs.

For example, Japanese Patent Application Laid-Open No. 63-247051 discloses ink droplet ejection apparatus of the shear mode type as ink droplet ejection apparatus of the drop-on-demand type. Piezoelectric material is used in the apparatus disclosed in the publication. FIGS. 23 and 24 of the drawings accompanying this specification show part of a conventional ink droplet ejection apparatus of the shear mode type.

The apparatus shown in FIGS. 23 and 24 includes a 64-channel multi-nozzle print head 600, only five channels of which are shown for simplification. The head 600 includes a bottom wall 601, at top wall 602 and a number of shear mode actuator walls 603 extending between them. Each actuator wall 603 includes an upper part 605 and a lower part 607 which are made of piezoelectric material. The wall parts 605 and 607 are bonded to the walls 602 and 601, respectively, and polarized oppositely as shown by arrows 609 and 611, respectively. The actuator walls 603 are arranged in pairs to define channels 613 between them. Spaces 615 are defined between successive pairs of actuator walls 603.

At one end of the channels 613 is secured a nozzle plate 617 formed with nozzles 618 for the respective channels. The other end of the channels 613 is connected through a manifold 626 to an ink cartridge or another ink supply (not shown). The manifold 626 includes a front wall 627 and a rear wall 628. The front wall 627 is formed with holes communicating with the respective channels 613. The rear wall 628 closes the space in the rear of the front wall 627 between the rear ends of the base wall 601 and top wall 602. Ink can be supplied from the supply to the space between the front wall 627 and rear wall 628, and then be distributed to the channels 613.

Electrodes 619 and 621 are disposed on opposite sides of each actuator wall 603. The electrodes 619 disposed in the channels 613 are connected to a drive circuit 21. Under the control of a control circuit 22, the drive circuit 21 can generate or output a voltage and apply it to these electrodes. The electrodes 621 disposed in the spaces 615 and on both sides of the print head 600 are connected to a ground return 623.

In operation, the voltage applied to the electrodes 619 in each channel 613 causes the actuator walls 603 facing the channel to deform piezoelectrically in such directions that the channel enlarges in volume. For example, if, as shown in FIG. 25 of the accompanying drawings, a voltage of E volts is applied to the electrodes 619 in one of the channels 613, electric fields are generated in the actuator walls 603 defining this channel. As shown by arrows 631 and 632, the fields are normal to the directions 609 and 611 of polarization. This deforms these walls 603 piezoelectrically in such directions that the channel 613 enlarges to reduce the pressure in the channel to a negative pressure.

The voltage applied to the electrodes 619 is held for a period L/V where L is the channel length and V is the sound velocity in the ink in the channel 613. While the voltage is applied, ink is supplied from the supply to the channel 613. The period L/V is the one-way propagation delay time T which it takes for the pressure wave in the channel 613 to be propagated one way longitudinally of the channel.

According to the theory of pressure wave propagation, the negative pressure in the channel 613 reverses into a positive pressure when the period L/V passes after the voltage is applied to the electrodes 619. If the voltage is returned to zero volt when this period passes after the voltage application, the deformed actuator walls 603 return to their original condition shown in FIGS. 23 and 24. This applies a positive pressure to the ink in the channel 613. This pressure is added to the pressure reversed to be positive. As a result, a relatively high pressure develops in that portion of the channel 613 which is near to the associated nozzle 618, ejecting ink out through the nozzle. The ejected ink sticks to a surface of printing paper or another recording medium to form an image on it.

The present assignee's Japanese Patent Application Laid-Open Nos. 9-29960, 9-29961 and 9-48112 disclose the step of ejecting ink out through a nozzle 618 by generating pressure wave vibration in the ink in the associated channel 613, and the step of substantially canceling the residual pressure wave vibration of the ink in the channel after the ejection. This cancellation involves generating an additional pulse after the main drive waveform for the ejection. Specifically, the cancellation involves increasing and decreasing the volume of the channel 613 by applying a voltage of E volts to the associated electrodes 619 at a predetermined time after the ejection and by subsequently returning the voltage to 0 volt. The cancellation damps the residual pressure wave vibration in the channel 613 quickly and early. This prevents ink from being ejected or dropped accidentally through the nozzle 618 by the residual pressure wave vibration. Besides, this enables early transition to the process in accordance with the next print command for this channel. It is therefore possible to form a more exact image on a recording medium, and improve the print speed.

The assignee's Japanese Patent Application Laid-Open No. 10-202858 discloses the steps of ejecting ink out through a nozzle 618 in a print cycle, and thereafter canceling the residual pressure wave vibration in the associated channel 613 if there is no print command for this channel for the following cycle, ibut canceling no such vibration if there is a print command therefor. If there is no print command for the following cycle, ;an accidental drop of ink may occur, and therefore the residual pressure wave vibration should be canceled. This results in better image formation not stained or spotted by scattered ink. If there is a print command for the following cycle, the residual pressure wave vibration in the channel 613 should be utilized positively. Specifically, this vibration should be added to the pressure wave vibration generated in accordance with the print command for this cycle. The addition generates greater pressure wave vibration for ejection of a larger ink droplet through the nozzle 618. Larger ink droplets increase the print density to form a thicker and clearer image.

It is conceivable that it is possible to damp or control ink meniscus vibration more effectively by switching between the execution and no execution of the vibration cancellation for a particular channel in a particular print cycle selectively depending on, not only whether there is a print command for the following cycle for this channel, but also whether there is a print command for the preceding cycle for the channel. This would stabilize the droplet jet velocity and the ejection, and make it possible to obtain an ink droplet of desired volume, thereby improving the print quality.

The viscosity and other characteristics of the ink in an apparatus vary with the temperature and other conditions at or in which the apparatus is used. It is desirable to perform the foregoing switching arbitrarily and easily depending on this variation as well. It has been desirable to generate a stop pulse for the vibration cancellation securely by means of simple structure or construction, depending on the preceding and/or following print data. It has also been desirable to ease the restrictions on the print waveforms for the cancellation.

SUMMARY OF THE INVENTION

In order to satisfy the foregoing desires, it is an object of the invention to provide an ink droplet ejection apparatus and an ink jet recorder which can switch securely between the execution and no execution of cancellation of ink pressure wave vibration for each cycle depending on whether there is a print command for at least one of the preceding and following cycles. It is another object to provide such an apparatus and a recorder which can modify the switching easily and arbitrarily depending on the conditions of use etc. It is still another object to provide such an apparatus and a recorder which are loose in constraint or limitation on print waveform for vibration cancellation even at a high print clock frequency, and which is high in degree of freedom of print waveform for vibration cancellation, so that suitable vibration cancellation can be made for better print quality.

In accordance with a first aspect of the invention, an ink droplet ejection apparatus is provided which includes:

An ink channel which is filled with ink;

an actuator for changing the volume of the ink channel;

a power source for applying electric signals to the actuator; and a controller for causing the source to apply to the actuator an ejection pulse signal for ejection of ink from the ink channel in accordance with a print command for a dot and an additional pulse signal for substantial cancellation of pressure wave vibration caused in the ink channel by the ejection.

The controller includes a plurality of storers for storing serial print data (ejection data) therein and transferring the stored data in order. The controller also includes an additional pulse data generator for making a logical operation based on the data from the storers and an output data combination selection signal to add an additional pulse to an ejection pulse.

When one of the storers stores therein the data bit for a certain print cycle if they are two storers, the other stores therein the data bit for the preceding or following cycle. When one of the storers stores therein the data bit for a certain print cycle if they are three storers, the others each store therein the data bit for one of the preceding and following cycles. The generator makes the logical operation based on the data from the storers and the combination selection signal to generate additional (stop) pulse data for the vibration cancellation.

There may be a case where no print data bit succeeds consecutive print data bits. More specifically, a certain dot may succeed a dot and precede no dot. In such a case, the ejection of ink is liable to be unstable. It is, however, possible to stabilize the ejection by switching between the execution and no execution of vibration cancellation (addition of stop pulse data).

The logical operation is made on the basis of a series of data from the storers and the combination selection signal to generate additional pulse data for vibration cancellation. This makes it possible to switch between the execution and no execution of vibration cancellation easily and arbitrarily with relatively simple structure, and raises the degree of freedom of print waveform for vibration cancellation.

It is not necessary for the cancellation to damp the pressure wave vibration completely. It may be necessary for the cancellation to damp the vibration to such a degree that no ink can be ejected from the channel.

The additional pulse data generator may include logic gate circuits each associated with one of all combinations of the data from the storers. In accordance with the selection signal, the appropriate gate circuit or circuits output data. By inputting the combination selection signal to the logic gate circuits, it is possible to switch properly between the execution and no execution of vibration cancellation for an arbitrary combination of the data from the storers. This produces the foregoing effect. The gate circuits will be described in detail with reference to FIG. 4A for embodiments of the invention.

The combination selection signal may be rewritten externally. By changing the selection signal externally and arbitrarily, it is possible to cancel the pressure wave vibration properly.

The combination selection signal may be determined depending on the temperature or other conditions at or in which the apparatus is used. The additional data generator may include a logical circuit for receiving the ejection data from the storers and the selection signal and making a logical operation of the received data and signal. This determination of the selection signal makes it possible to cancel the pressure wave vibration properly.

The channel may include a plurality of channels. The actuator may include actuators each associated with one of the channels. The apparatus may further comprise an image memory for storing therein print data for the respective channels. One of the storers may be a serializer (parallel-serial converter) for holding the print data transferred in parallel from the memory, and outputting the held data in series to make a parallel-serial conversion of the print data. Another of the storers may be a first shift register for receiving the print data output in series from the serializer, shifting the received data therein, and outputting in series the print data stored therein. Still another of the storers may be a second shift register for receiving the print data output in series from the first register, shifting the received data therein, and outputting in series the print data stored therein.

When the first shift register outputs the data for a certain print cycle, the serializer outputs the data for the following cycle, and the second shift register outputs the data for the preceding cycle. The additional pulse data generator makes a logical operation based on the data output for each of the channels from the serializer and the registers.

In this case, depending on the data for the following and preceding cycles for each channel, it is possible to switch securely between the execution and no execution of vibration cancellation for the certain cycle for the channel. This produces the foregoing effect.

The image memory, the serializer, the shift registers and the additional pulse data generator will be described in detail with reference to FIGS. 3 and 11 of the drawings.

In accordance with a second aspect of the invention, an ink droplet ejection apparatus is provided which includes:

an ink channel which is filled with ink;

an actuator for changing the volume of the ink channel;

a power source for applying electric signals to the actuator; and a controller for causing the source to apply to the actuator an ejection pulse signal for ejection of ink from the ink channel in accordance with a print command for a dot and an additional pulse signal for substantial cancellation of pressure wave vibration caused in the ink channel by the ejection.

This controller includes three storers for storing serial print data therein and transferring the stored data in order. The controller also includes a logical operator (for making a logical operation based on the print data stored in the storers, and determining whether an additional (stop) pulse should be generated.

This logical operation may be set suitably, and based on a combination of the data bit stored for a certain print cycle in one of the three storers, the data bit stored for the preceding cycle in another, and the data bit stored for the following cycle in the other. If the operation results in the execution of vibration cancellation, a stop pulse is added to the ejection pulse for the certain cycle.

If continuous printing halts, the ejection of ink is liable to be unstable. This apparatus can, however, damp the ink meniscus vibration effectively. This stabilizes the droplet jet velocity and the ejection. It is therefore possible to eject ink droplets of desired volume.

The channel and the actuator of this apparatus may include a plurality of channels and actuators, respectively. The channels are each associated with one of the actuators. The apparatus may further comprise an image memory for storing therein print data for the respective channels. One of the three storers may be a serializer for holding the print data transferred in parallel from the memory, and outputting the held data in series to make a parallel-serial conversion of the print data. Another of the storers may be a first shift register for receiving the print data output in series from the serializer, shifting the received data therein, and outputting in series the print data stored therein. The other of the storers may be a second shift register for receiving the print data output in series from the first register, shifting the received data therein, and outputting in series the print data stored therein.

When the first register outputs the data for a certain print cycle, the serializer outputs the data for the following cycle, and the second register outputs the data for the preceding cycle. The logical operator makes a logical operation based on the print data output for each of the channels from the serializer and the registers.

In this case, depending on the data for the following and preceding cycles for each channel, it is possible to switch securely between the execution and no execution of vibration cancellation for the certain cycle for the channel. This produces the foregoing effect.

Each cycle may include a first period and a second period following the first. The controller may transfer an ejection pulse signal and an additional pulse signal in the first and second periods, respectively. This enables the data to be transferred in series from the controller to the drive circuit, thereby simplifying the wiring.

The logical operator of this apparatus may make a logical operation of the data from the three storers and a selection signal determined depending on temperature or conditions of use. Only by changing the selection signal suitably, it is easy to cancel the pressure wave vibration optimally at each temperature or in each condition of use.

The controller of this apparatus may include a gate array. The array includes the serializer, the shift registers and the logical operator. The controller may also include a drive circuit for driving the actuators with the output from the array. This makes it possible to meet various needs by modifying only the logical circuit of the gate array without modifying the drive circuit, which may be located in a print head unit.

This controller may also include a first serial-parallel converter and a second serial-parallel converter. The first converter receives the print data output in series from one of the storers, and converts the serial print data into parallel data. The second converter receives the additional pulse data output in series from the logical operator, and converts the serial pulse data into parallel data. The controller may further include a switch for switching the output from the two converters cyclically.

Additional pulse data are generated as stated above. The print data and the additional pulse data are input to the first and second serial-parallel converters, respectively. The output from the converters is switched cyclically so that ejection pulses and additional pulses can be processed separately. This enables an arbitrary drive waveform to be produced and used for vibration cancellation even at a higher print frequency.

The two serial-parallel converters and the switch will be described in detail with reference to FIGS. 10 and 13 of the drawings.

The controller may include a gate array. The array may include the serializer, the shift registers and the logical operator. The controller may also include a drive circuit for driving the actuator with the output from the array. The drive circuit includes the serial-parallel converters and the switch.

This drive circuit may be located in a print head unit, and includes the serial-parallel converters and the switch. This makes it possible to transfer the print data and the stop pulse data via two data lines from the controller to the drive circuit. It is therefore possible to transfer sufficient data, and thereby process data at a high print frequency.

In accordance with a third aspect of the invention, an ink droplet ejection apparatus is provided which includes:

a plurality of channels which are filled with ink;

actuators each for changing the volume of one of the channels;

a memory for storing therein print data for driving the respective actuators;

a controller for transferring in series the print data from the memory;

a first serial-parallel converter for holding the transferred serial data and outputting the held data in parallel and series;

a second serial-parallel converter for holding the data transferred in series from the first converter, and outputting the held data in parallel and series; and a third serial-parallel converter for holding the data transferred in series from the second converter, and outputting the held data in parallel and series.

When the second converter outputs the data in parallel for a certain cycle, the first converter outputs the data in parallel for the following cycle, and the third converter outputs the data in parallel for the preceding cycle.

This apparatus also includes a logical operator which can generate an additional pulse data bit for each of the channels for the certain cycle by making a logical operation based on the data output for the channel from the three converters.

Applied to each of the actuators are an ejection pulse signal based on the print data for ejection of ink from the associated channel in accordance with a print command for a dot and the signal output from the operator for substantial cancellation of pressure wave vibration caused in the channel by the ejection.

Thus, the logical operation is based on the output from the three serial-parallel converters to generate additional pulse data. This makes it possible to cancel vibration by generating additional pulse data easily and arbitrarily with relatively simple structure, and raises the degree of freedom of print waveform for vibration cancellation.

The actuators, the three serial-parallel converters and the logical operator of this apparatus may be formed on a carriage for moving the ink droplet ejection apparatus along a printing medium. In this case, the operator for generating additional pulses is located on the carriage. Therefore, without modifying the body of an image recorder in particular, it is possible to modify the ink droplet ejection apparatus of the recorder to an apparatus which can generate arbitrary additional pulses.

In accordance with a fourth aspect of the invention, an ink droplet ejection apparatus is provided which includes:

a channel which is filled with ink;

an actuator for changing the volume of the channel;

a power source for applying electric signals to the actuator;

a controller for causing the source to apply to the actuator an ejection pulse signal for ejection of ink from the channel in accordance with a print command for a dot and an additional pulse signal for substantial cancellation of pressure wave vibration caused in the channel by the ejection; and an image memory for storing therein a series of print data for ejecting ink from the channel.

This controller includes:

three storers for storing therein and transferring in order print data stored in the memory;

a logical operator for generating the additional pulse, as the need arises, by making a logical operation based on the print data stored for three consecutive data (dots) in the storers, the operator storing the generated additional pulse in the memory; and a transferor for transferring to the actuator the print data and the additional pulse data stored in the memory.

When one of these storers stores therein the data bit (print data) for a certain print cycle, another stores therein the data bit for the preceding cycle, and the other stores therein the data bit for the following cycle. The logical operation is based on the data from the storers to generate an additional pulse data bit, which is stored in the image memory. The transferor transfers the stored print data and the additional pulse data to the actuator.

There may be a case where a certain dot succeeds a dot and precedes no dot. In such a case, this apparatus makes it possible to switch between the execution and no execution of vibration cancellation for the certain dot. It is therefore possible to stabilize the ejection of ink.

This apparatus will be described in detail with reference to FIGS. 20–22 of the drawings.

The storers of this apparatus may be a first register, a second register and a third register for holding the data from the image memory. When the second register holds the data bit for a certain print cycle, the first and third registers hold the data for the following and preceding cycles, respectively. The logical operation is based on the data from the three registers. This makes it possible to switch securely between the execution and no execution of vibration cancellation for the certain cycle depending on the data for the preceding and following cycles.

The logical operator of this apparatus may make a logical operation of the data from the three storers and a selection signal determined depending on temperature or conditions of use. Only by changing the selection signal properly, it is easy to cancel vibration optimally at each temperature or in each condition of use.

The controller of this apparatus may include a gate array, which includes the three registers and the logical operator. The controller may also include a drive circuit for driving the actuator with the output from the array. This makes it possible to meet various needs by modifying only the logical circuit of the gate array without modifying the drive circuit, which may be located in a print head unit.

According to the fifth aspect of the invention, a ink jet recorder is provided, which comprises: an ink jet head including an ink channel which is filled with ink, and an actuator for changing the volume of the ink channel; a power source for applying electric signals to the actuator; and a controller for causing the source to apply to the actuator an ejection pulse signal for ejection of ink from the ink channel in accordance with a print command for a dot and an additional pulse signal for substantial cancellation of pressure wave vibration caused in the ink channel by the ejection; the controller including: a plurality of storers for storing serial print data therein and outputting the stored data in order; an additional pulse data generator for making a logical operation based on the data from the storers and an output data combination selection signal to add an additional pulse to an ejection pulse.

According to the sixth aspect of the invention, a ink jet recorder is provided, which comprises: an ink jet head including an ink channel which is filled with ink, and an actuator for changing the volume of the channel; a power source for applying electric signals to the actuator; and a controller for causing the source to apply to the actuator an ejection pulse signal for ejection of ink from the ink channel in accordance with a print command for a dot and an additional pulse signal for substantial cancellation of pressure wave vibration caused in the ink channel by the ejection; the controller including: three storers for storing serial print data therein and transferring the stored data in order; and a logical operator for making a logical operation based on the print data stored in the storers, and determining whether an additional pulse should be generated.

According to the seventh aspect of the invention, a ink jet recorder is provided, which comprises: an ink jet head including a plurality of channels which are filled with ink, and actuators each for changing the volume of one of the channels; a memory for storing therein print data for driving the respective actuators; a controller for transferring in series the print data from the memory; a first serial-parallel converter for holding the transferred serial data and outputting the held data in parallel and series; a second serial-parallel converter for holding the data transferred in series from the first converter, and outputting the held data in parallel and series; a third serial-parallel converter for holding the data transferred in series from the second converter, and outputting the held data in parallel and series; the first converter outputting the data in parallel for a cycle following a certain cycle when the second converter outputs the data in parallel for the certain cycle; the third converter outputting the data in parallel for a cycle preceding the certain cycle when the second converter outputs the data in parallel for the certain cycle; and a logical operator for generating an additional pulse data bit for each of the channels for the certain cycle by making a logical operation based on the data output for the channel from the three converters; whereby an ejection pulse signal based on the print data for ejection of ink from each of the channels in accordance with a print command for a dot and the signal output from the operator for substantial cancellation of pressure wave vibration caused in the channel by the ejection are applied to the associated actuator.

According to the eighth aspect of the invention, a ink jet recorder is provided, which comprises: an ink jet head including a channel which is filled with ink, and an actuator for changing the volume of the channel; a power source for applying electric signals to the actuator; a controller for causing the source to apply to the actuator an ejection pulse signal for ejection of ink from the channel in accordance with a print command for a dot and an additional pulse signal for substantial cancellation of pressure wave vibration caused in the channel by the ejection; and an image memory for storing therein a series of print data for ejecting ink from the channel; the controller including: three storers for storing therein and transferring in order the print data stored in the memory; a logical operator for generating the additional pulse by making a logical operation based on the print data stored for three consecutive data in the storers, the operator storing the generated additional pulse in the memory; and a transferor for transferring to the actuator the print data and the additional pulse data stored in the memory.

BRIEF DESCRIPTION OF THE DRAWINGS

Preferred embodiments of the invention will be described with reference to the accompanying drawings, in which:

FIG. 4B is a table of print data combinations and transfer data control signals for this generator;

FIG. 23 is taken on the line X—X of FIG. 24;

DETAILED DESCRIPTION OF THE PREFERRED EMBODIMENTS

Figure 1:
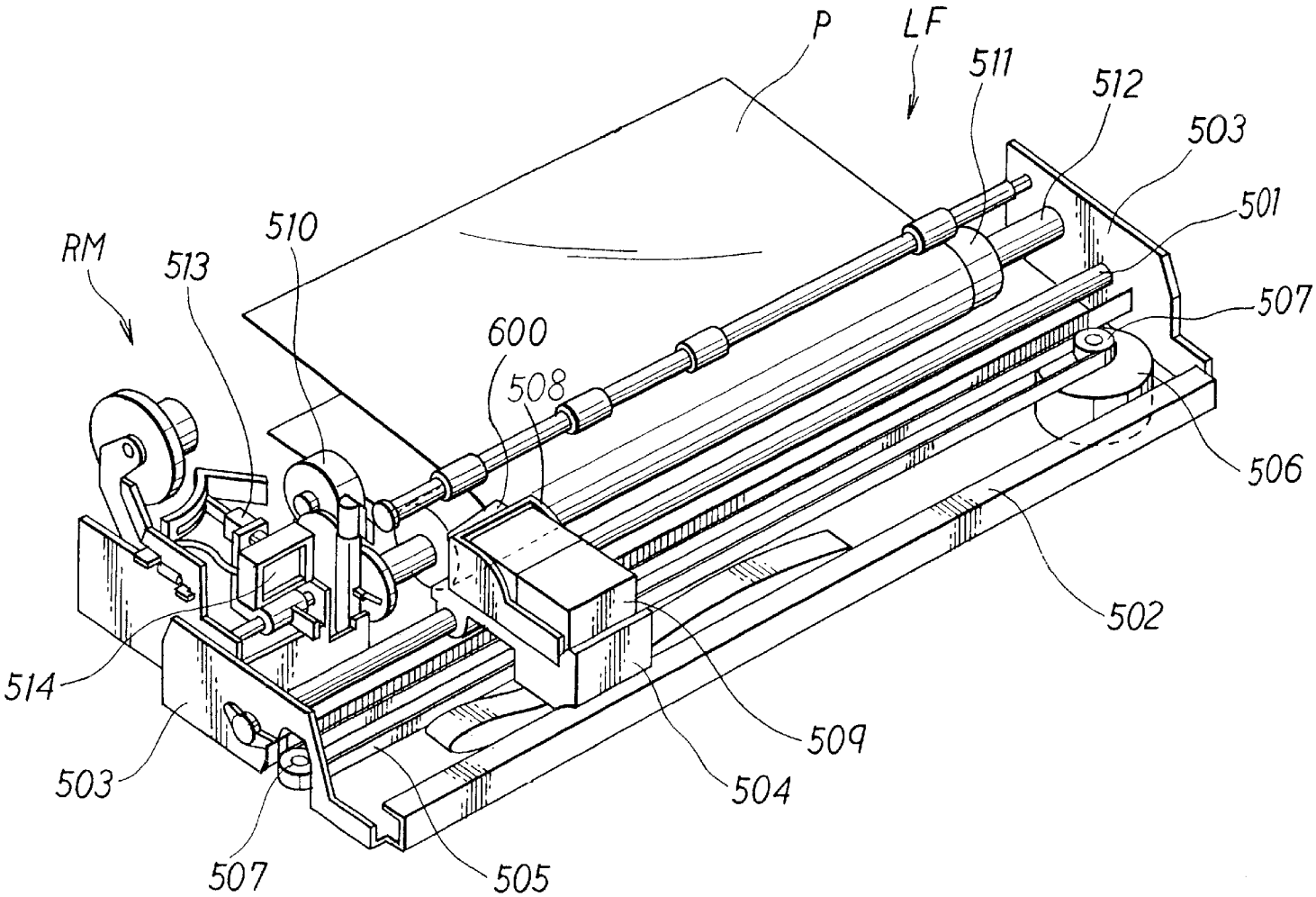
FIG. 1 is a schematic perspective view of the common structure of ink jet printers fitted with ink ejection apparatus according to the embodiments.

With reference to FIG. 1, the common structure of the ink jet printers embodying the invention includes a 64-channel multi-nozzle print head 600. Because this head is basically identical in mechanical structure to the conventional head 600 shown in FIGS. 23–25, the description of it will be omitted with the same reference numerals used for the counterparts.

The common structure also includes a printer frame, which includes a pair of side plates 503. A guide rod 501 and a guide rail 502 extend in parallel between the plates 503. A carriage 504 is supported on the rod 501 and rail 502 slidably along them. The carriage 504 is fastened to a timing belt 505, which can be driven by a carriage motor 506 to reciprocate the carriage. The belt 505 extends between a pair of pulleys 507, which are positioned near both ends of the rod 501 and rail 502. One of the pulleys 507 is connected to the drive shaft of the motor 506.

The carriage 504 carries a head unit 508, which includes the print head 600 and a drive circuit (not shown). The drive circuit is a one-chip IC, which is connected via a flexible harness cable (not shown) to a control circuit (not shown) in the printer body. The carriage 504 also carries an ink cartridge 509 mounted removably on its rear to supply ink to the channels 613 of the head 600.

The common structure further includes a feed mechanism LF for feeding a sheet of printing paper P. The mechanism LF includes a platen roller 511, which can be driven by a feed motor 510 to feed the sheet P perpendicularly to the directions in which the carriage 504 moves. The shaft 512 of the roller 511 is supported rotatably by one of the side plates 503 and part of the printer frame.

Positioned on one side of the feed mechanism LF is a maintenance and recovery mechanism RM for maintaining and recovering good condition of ink ejection from the print head 600. The mechanism RM includes a suction mechanism 513 and a preservation cap 514. While the head 600 is used, the ink in it may dry or dehydrate, and air bubbles may be produced in it. Besides, ink droplets may stick to the outer side of the nozzle plate 617 of the head 600. This may cause defective ejection of ink. In order to eliminate the defective condition of ejection, the suction mechanism 513 sucks ink out through the nozzles 618 with the cap 514 capping the nozzle plate 617. While the printer is not used, the cap 514 caps the nozzle plate 617 to function additionally as a cover for preventing ink from drying.

Figure 2:
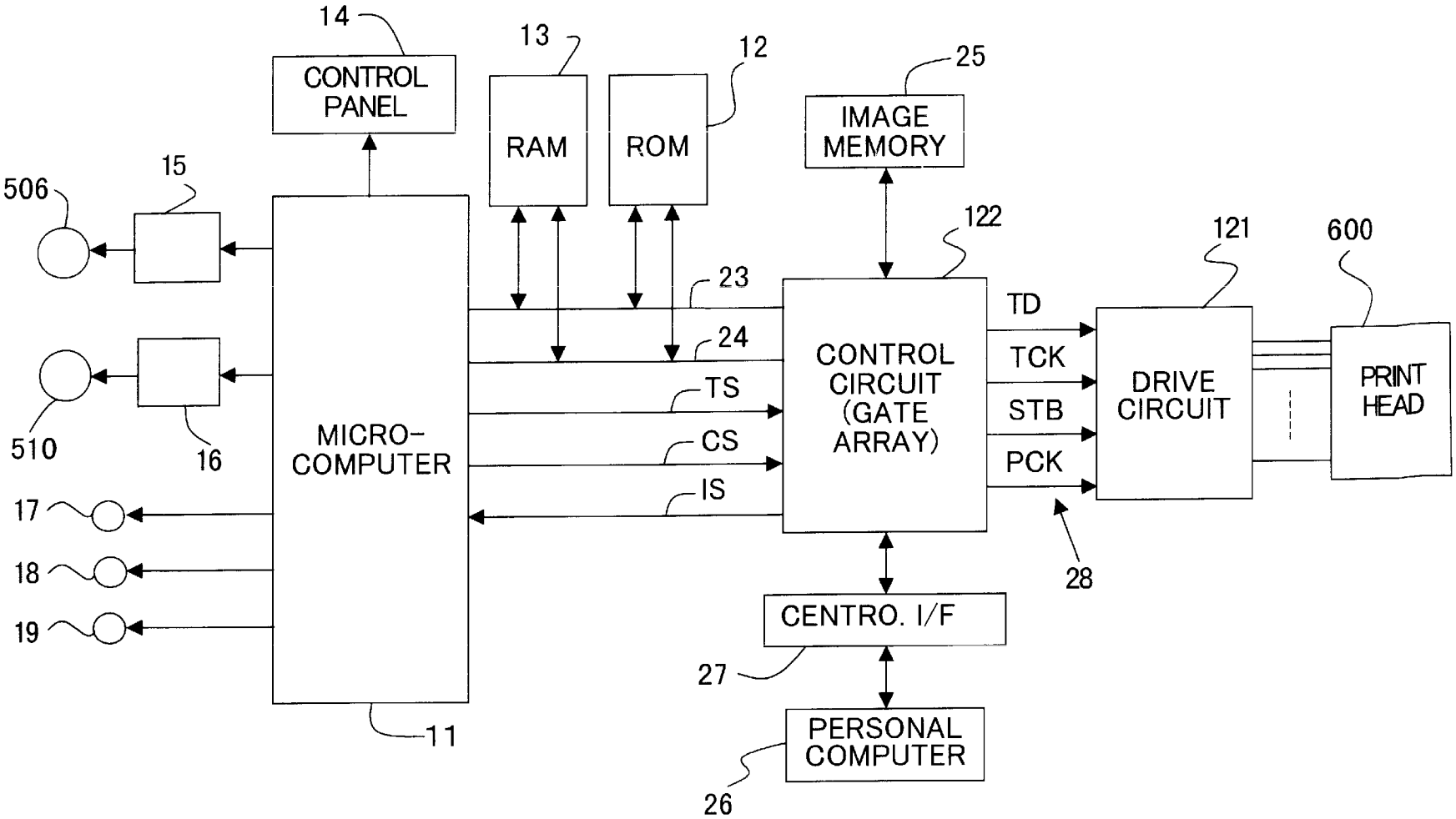
FIG. 2 is a block diagram of the electric system of the printer fitted with the apparatus according to a first embodiment of the invention.

FIG. 2 shows the electric system of the printer fitted with the apparatus according to the first embodiment.

The control system of this printer includes a one-chip microcomputer 11, a ROM 12 and a RAM 13. The microcomputer 11 is connected to a control panel 14, motor energization circuits 15 and 16, a paper sensor 17, a home position sensor 18, a current position sensor 19, etc. The panel 14 can be used for the users' print instructions etc. The energization circuits 15 and 16 can energize the carriage motor 506 and the feed motor 510, respectively. The paper sensor 17 can detect the front end of a sheet of printing paper P as a recording medium. The home position sensor 18 can detect the home position of a carriage 504. The current position sensor 19 can detect the current or moving position of the carriage 504.

Figure 23:
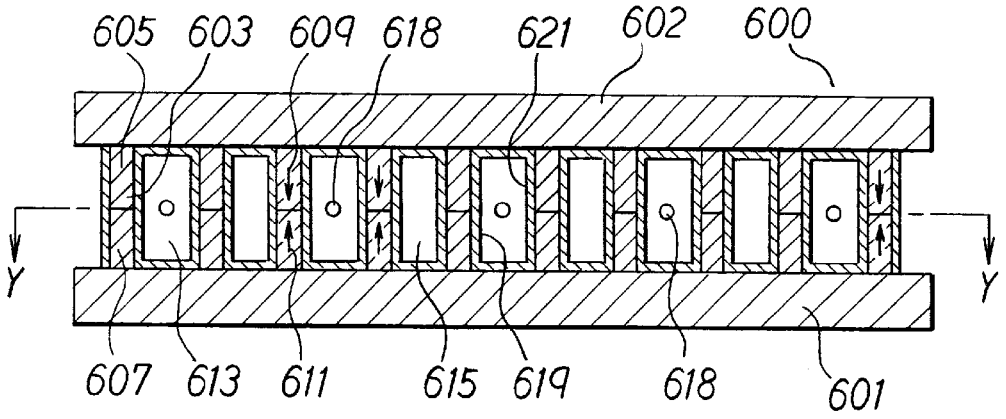
Fig. 23 RELATED ART
FIG. 23 is a sectional elevation of the print head which is common to the conventional apparatus and the apparatus according to the embodiments.
Figure 24:
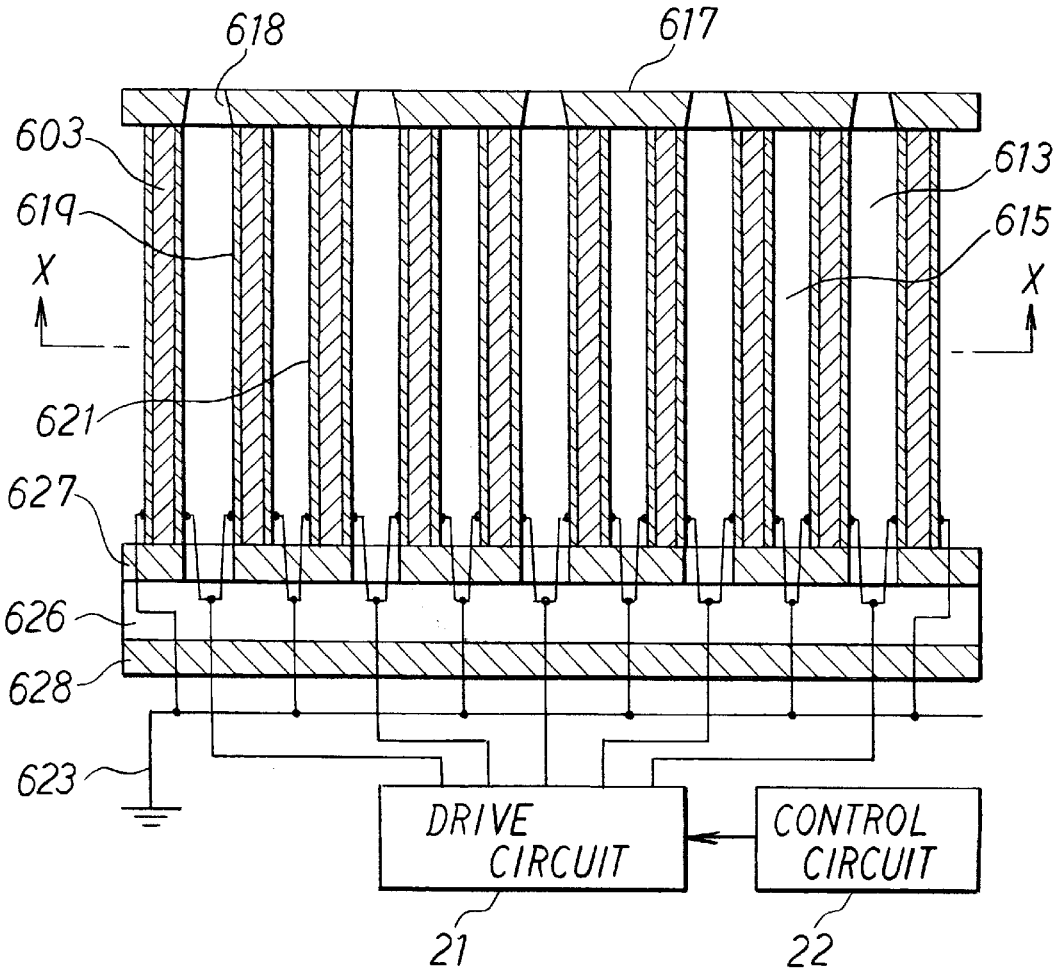
Fig. 24 RELATED ART
FIG. 24 is a sectional plan taken on the line Y—Y of FIG. 23.
Figure 25:
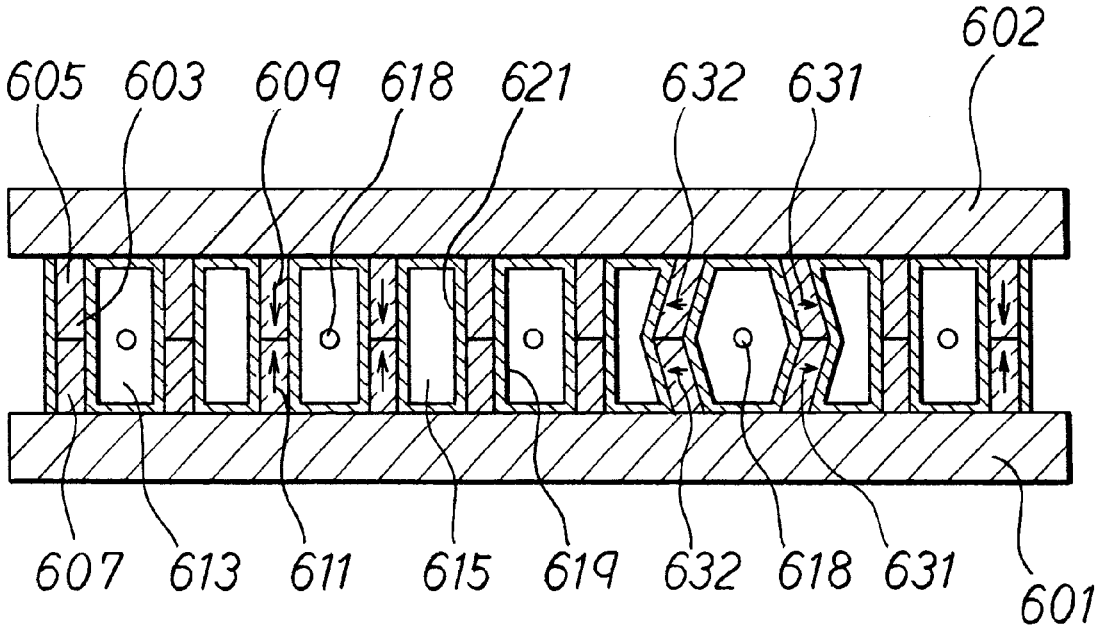
Fig. 25 RELATED ART
FIG. 25 is a sectional elevation of the print head of FIGS. 23 and 24, showing the head operation.

The printer includes a 64-channel multi-nozzle print head 600 which is basically identical to the conventional head 600 shown in FIGS. 23–25. This head 600 can be driven by a drive circuit 121, which is a one-chip IC. The drive circuit 121 is controlled by a control circuit 122, which is a gate array. The drive circuit 121 is connected to the electrodes 619 (FIG. 24) in the channels 613 of the head 600. Under the control of the control circuit 122, the drive circuit 121 can generate a voltage which is suitable for the head 600, and apply the voltage to the electrodes 619.

The microcomputer 11 is connected to the ROM 12, the RAM 13 and the control circuit 122 via an address bus 23 and a data bus 24. In accordance with the program stored in advance in the ROM 12, the microcomputer 11 generates a print timing signal TS and a control signal CS, and transfer them to the control circuit 122.

The control circuit 122 causes print data transferred from a personal computer 26 or other external apparatus via a Centronics interface 27 to be stored in an image memory 25. On the basis of Centronics data transferred from this computer 26 or the like via the interface 27, the control circuit 122 generates a Centronics data receive interrupt signal IS, and transfers it to the microcomputer 11.

In accordance with the print timing signal TS and the control signal CS, the control circuit 122 generates:

- transfer data TD which are the print data for forming the images on printing paper P on the basis of the print data stored in the image memory 25; and
- a transfer clock TCK, a strobe signal STB and a print clock PCK for synchronism with the transfer data TD.

The generated data and signals TD, TCK, STB and PCK are transferred to the drive circuit 121 through a flexible harness cable 28, which connects the control circuit 122 in the printer body and the drive circuit 121 on the carriage 504.

Figure 3:
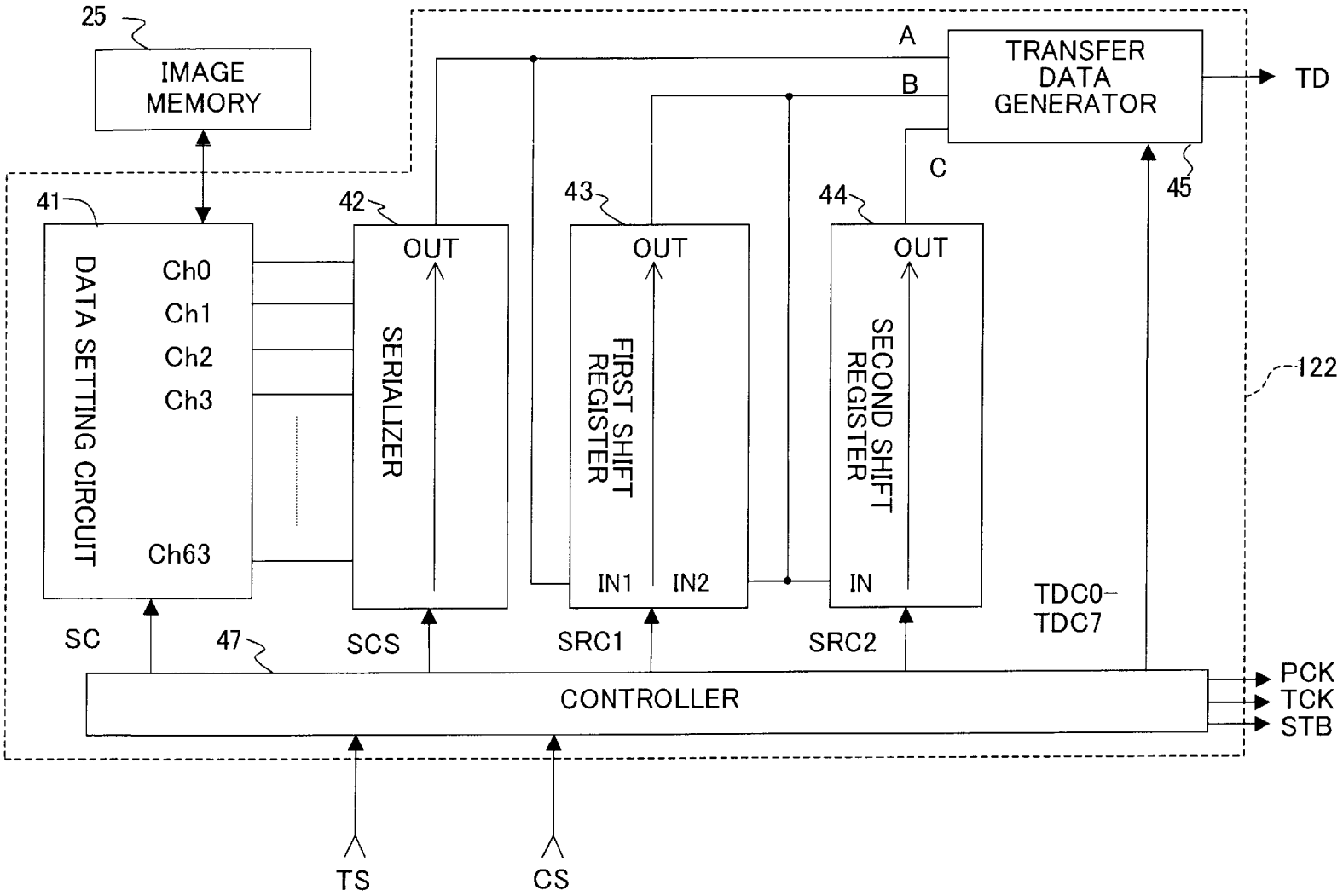
FIG. 3 is a block diagram of the control circuit shown in FIG. 2.

With reference to FIG. 3, the control circuit 122 includes a data setting circuit 41. The control circuit 122 also includes a 64-bit serializer (serial-parallel converter) 42, a first 64-bit shift register 43 and a second 64-bit shift register 44 as three devices for storing data. The control circuit 122 further includes a transfer data generator 45 as a device for generating additional pulse data, and a controller 47.

In accordance with the print timing signal TS and the control signal CS from the microcomputer 11, the controller 47 generates a setting command SC, a serialization control signal SCS, two shift register control signals SRC1 and SRC2, and eight transfer data control signals TDC0–TDC7 for controlling the circuits 41–45. The controller 47 also generates the strobe signal STB, the transfer clock TCK and the print clock PCK.

The data setting circuit 41 reads out print data in parallel from the image memory 25, and outputs them in parallel to the serializer 42 in accordance with the setting command SC.

In accordance with the serialization control signal SCS, the serializer 42 receives the print data Ch0–Ch63 for each print cycle in parallel from the respective channels of the data setting circuit 41, and holds them in itself. When pulses of a shift clock SCK (FIGS. 5 and 6) rise, the serializer 42 outputs the data Ch0–Ch63 in that order, by one bit at a time, in series through its serial output terminal OUT. This makes a parallel-serial conversion of the data Ch0–Ch63. At the same time, the serial data Ch0–Ch63 from the serializer 42 are input as ejection data A to the transfer data generator 45, and to one serial input terminal IN1 of the first shift register 43.

In accordance with the shift register control signal SRC1, the first shift register 43 receives the serial print data Ch0–Ch63 in series from the serializer 42, and holds them in itself. When shift clock pulses SCK rise, this register 43 outputs the data Ch0–Ch63 in that order, by one bit at a time, in series through its serial output terminal OUT. The serial data Ch0–Ch63 from this terminal OUT are input as ejection data B to the transfer data generator 45, and to the other serial input terminal IN2 of the register 43 when the control signal SRC1 changes over.

In accordance with the shift register control signal SRC2, the second shift register 44 receives the serial print data Ch0–Ch63 in series from the first shift register 43, and holds them in itself. When shift clock pulses SCK rise, this register 44 outputs the data Ch0–Ch63 in that order, by one bit at a time, in series through its serial output terminal OUT. The serial data Ch0–Ch63 from the register 44 are input as ejection data C to the transfer data generator 45.

When the first shift register 43 outputs the print data Ch0–Ch63 for a certain print cycle as ejection data B, the serializer 42 outputs the print data Ch0–Ch63 for the following cycle as ejection data A, and the second shift register 44 outputs the print data Ch0–Ch63 for the preceding cycle as ejection data C.

The transfer data generator 45 functions as a device for generating additional pulse data. The generator 45 receives the serial ejection data A–C from the serializer 42 and the shift registers 43 and 44. The generator 45 makes logical operations of the data A–C and the transfer data control signals TDC0–TDC7, which may be suitably determined depending on temperature and other conditions. The generator 45 outputs transfer data TD to the drive circuit 121 in synchronism with the transfer clock TCK, the strobe signal STB and the print clock PCK.

Figure 8:
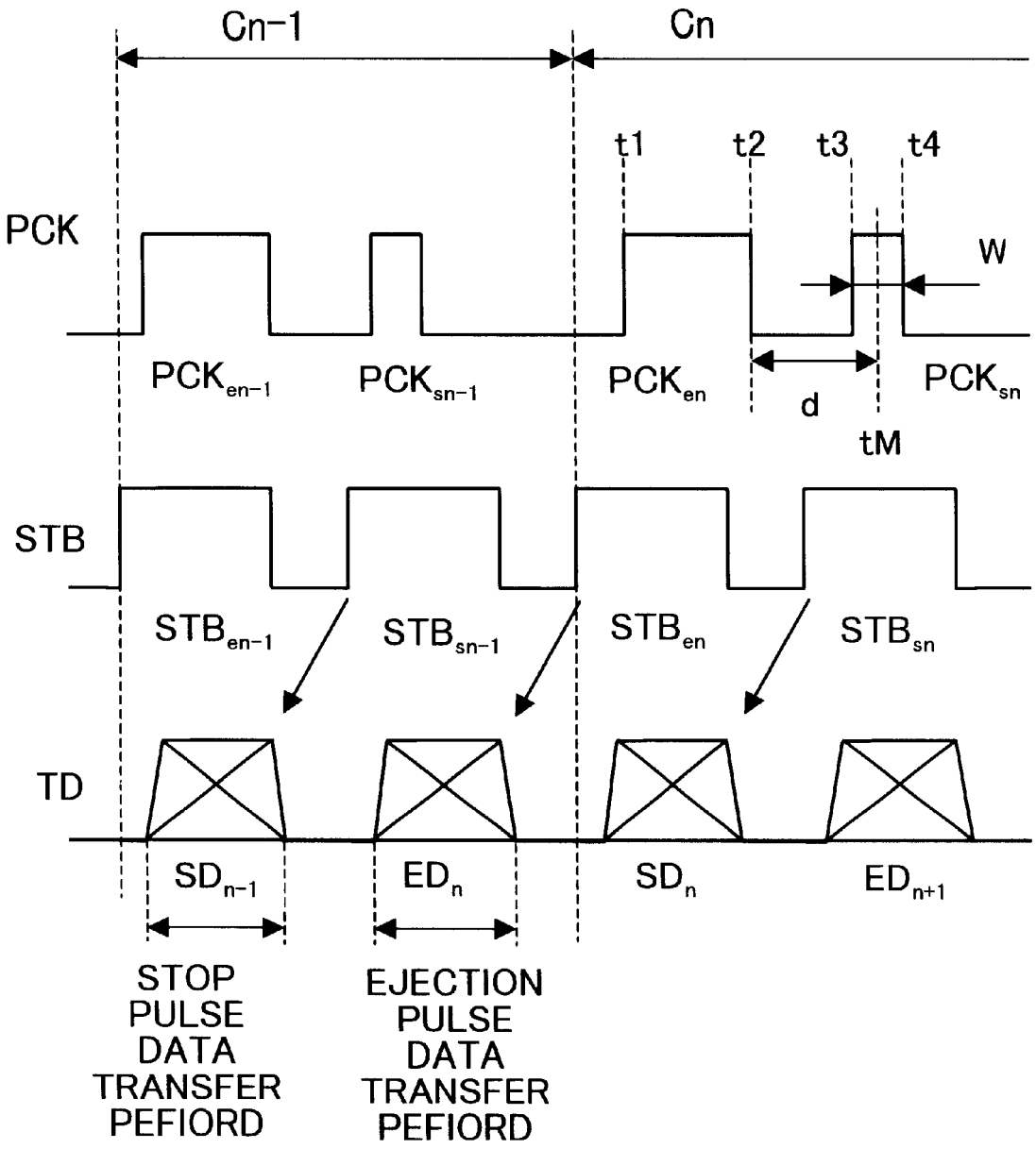
FIG. 8 is another time chart of signals and data in this embodiment.

As shown in FIG. 8, the transfer data TD consist of ejection pulse data ED on the ejection of ink from the channels 613 of the print head 600 and stop pulse data SD on the cancellation of the residual pressure wave vibration in the channels.

If the print head 600 did not have 64 channels, it would only be necessary for the bits of the serializer 42 and shift registers 43 and 44 to be equal in number to the channels of the head.

Figure 4A:
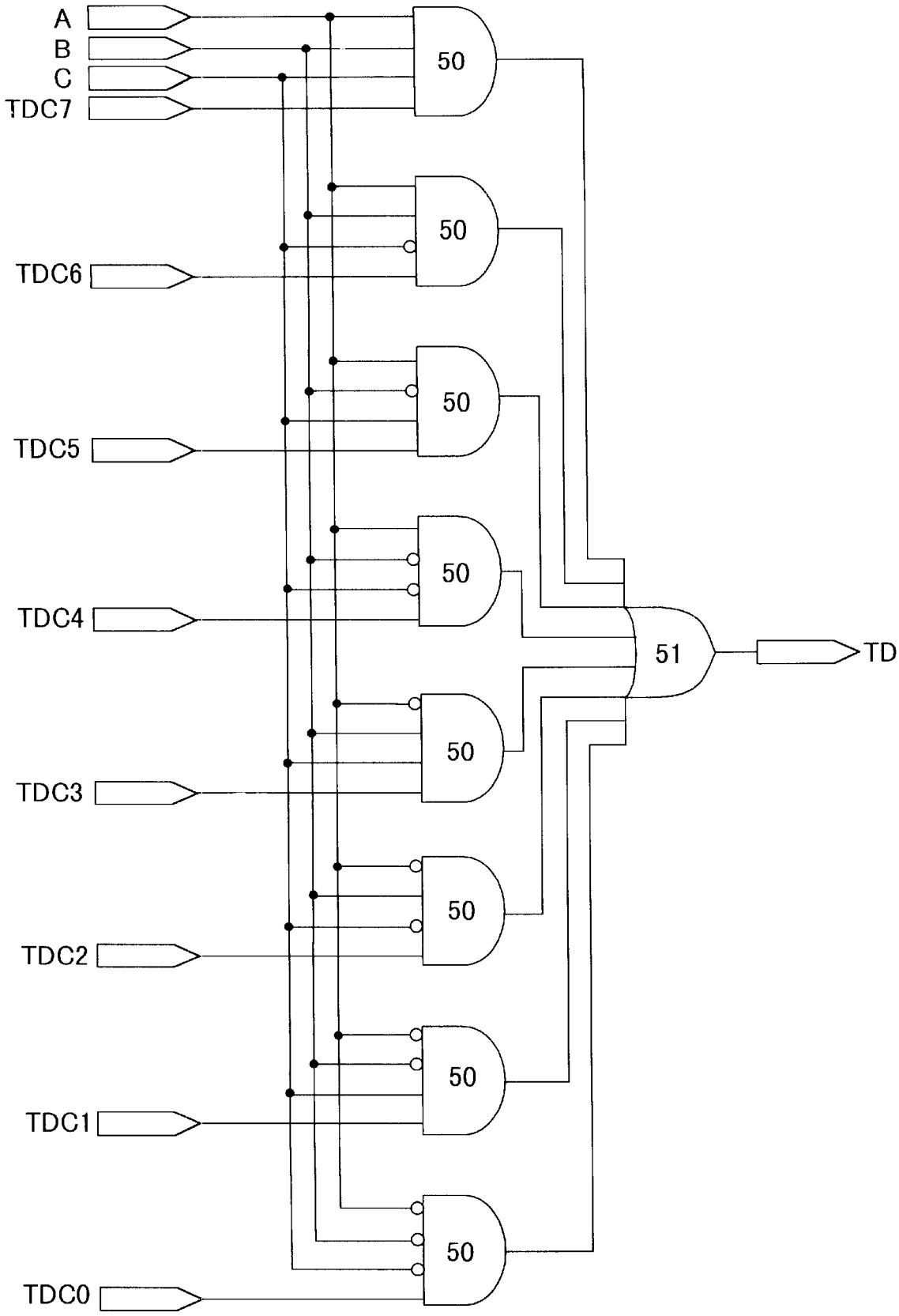
FIG. 4A is a circuit diagram of the transfer data generator shown in FIG. 3.

With reference to FIG. 4A, the transfer data generator 45 includes logical circuits, which are eight AND gates 50 and an OR gate 51. Each AND gate 50 has four input terminals. The OR gate 51 has eight input terminals, which are connected to the output terminals of the respective AND gates 50. The AND gates 50 receive the respective transfer data control signals TDC0–TDC7 from the controller 47 and the ejection data A–C from the serializer 42 and shift registers 43 and 44. The data A–C are input to the AND gates 50 directly or through inverter gates, as shown in FIG. 4A, for all combinations of the data. By suitably selecting the logical level of each of the signals TDC0–TDC7, it is possible to output any of the data A–C or a signal based on any combination of them.

FIG. 4B shows all the combinations of the ejection data A–C for stop pulse generation, and the transfer data control signals TDC0–TDC7 for the respective combinations. For example, if only TDC7 is "1" and TDC0–TDC6 are "0", an additional stop pulse is generated and output as a bit of transfer data TD from the OR gate 51 only when the data A–C are all "1". If the data A–C are "1" or high in logical level, they represent dots. If these data are "0" or low in logical level, they represent no dots.

As shown in FIG. 8, a print cycle Cn succeeds a print cycle Cn−1. The cycle Cn precedes a print cycle Cn+1 (not shown). Each cycle includes a stop pulse data transfer period and an ejection pulse data transfer period after the stop pulse data transfer period.

Figure 5:
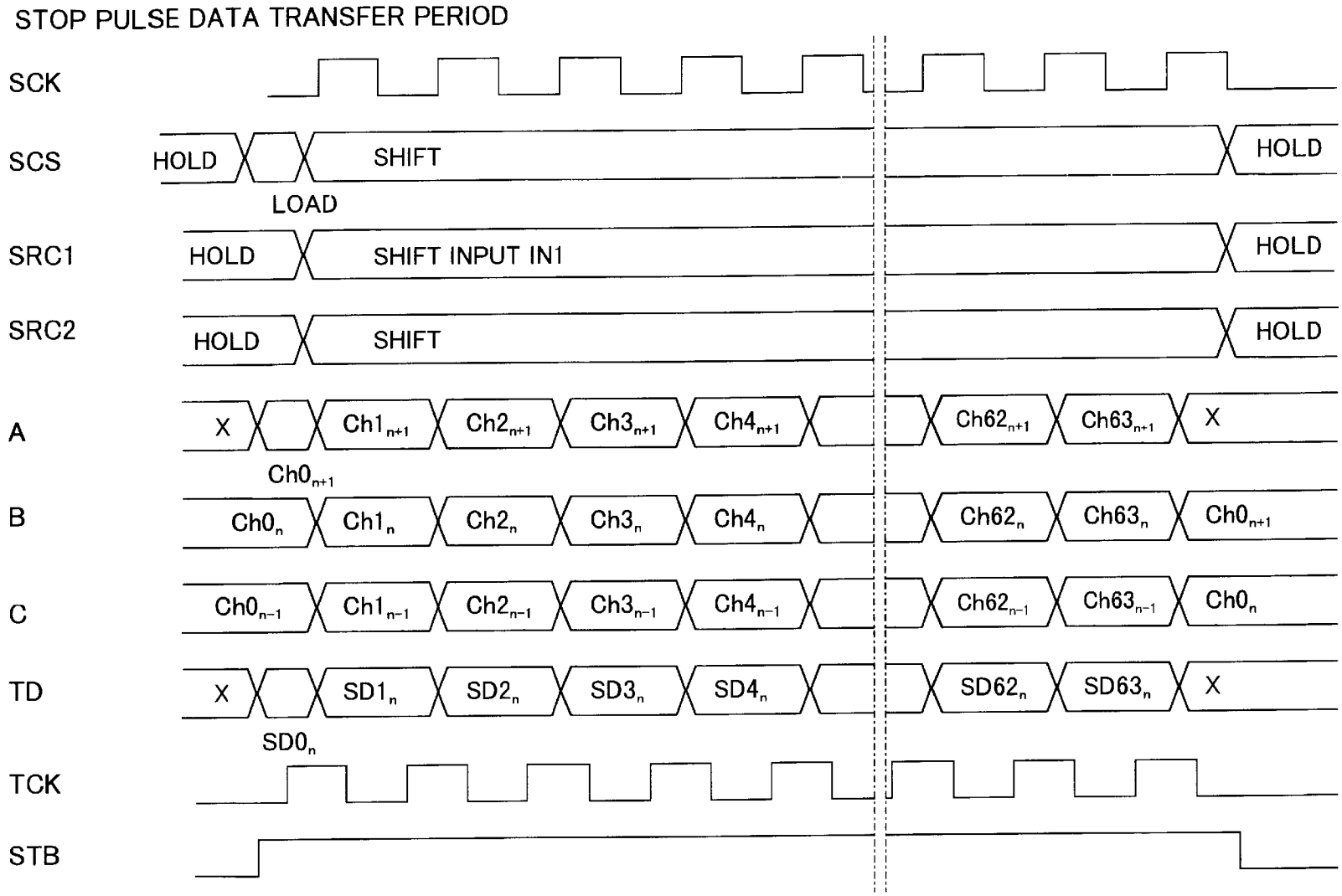
FIG. 5 is a time chart of signals and data during the stop pulse data transfer period of a print cycle of this embodiment.
Figure 6:
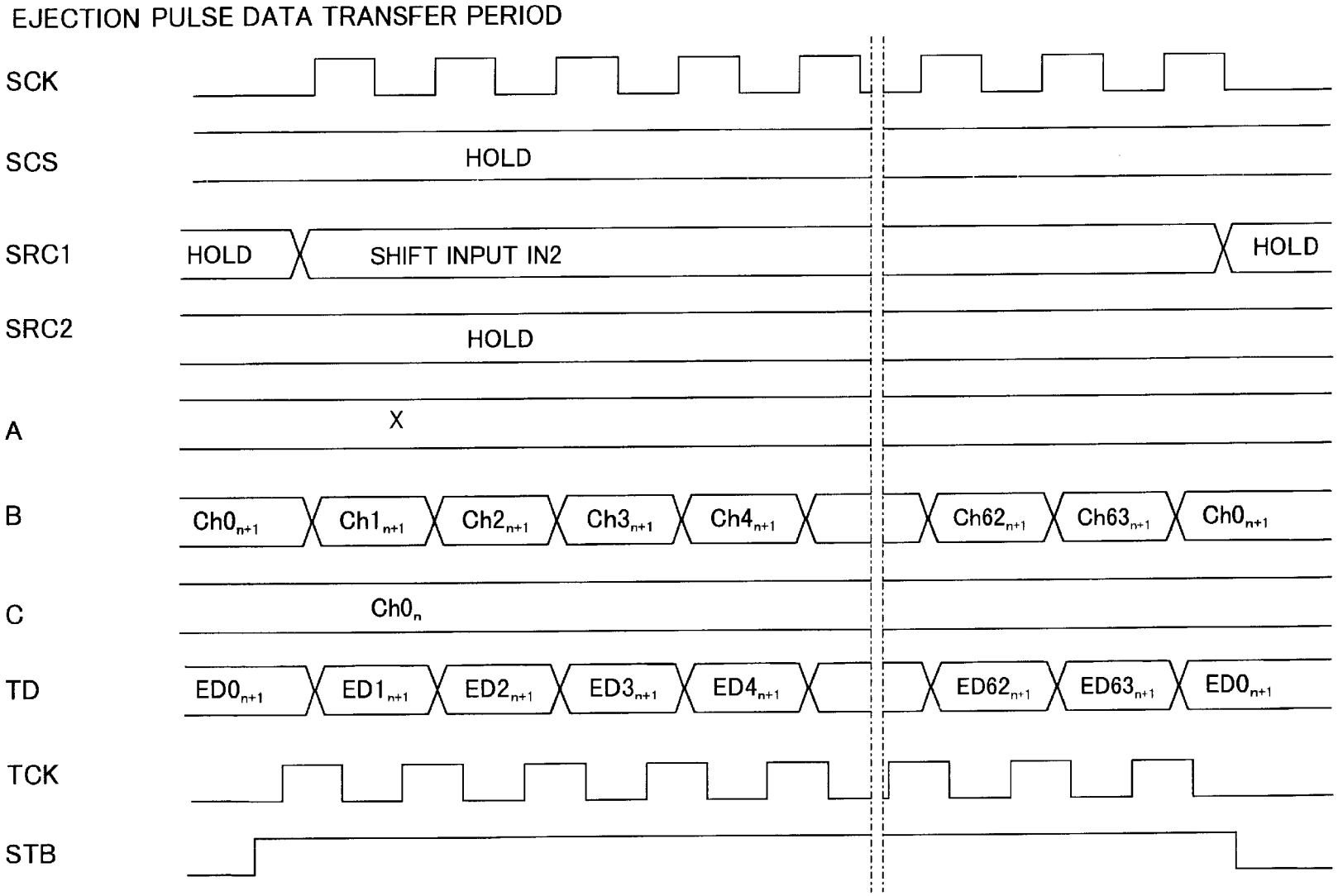
FIG. 6 is a time chart of signals and data during the ejection pulse data transfer period of this cycle.

FIGS. 5 and 6 show the stop pulse data transfer period and the ejection pulse data transfer period, respectively, of the cycle Cn−1 (FIG. 8). In the stop pulse data transfer period, the stop pulse data SDn−1 (FIG. 8) for the cycle Cn−1 are transferred as transfer data TD. In the ejection pulse data transfer period, the ejection pulse data EDn (FIG. 8) for the next cycle Cn are transferred as transfer data TD.

With reference to FIG. 5, the operation of the control circuit 122 during the stop pulse data transfer period will be explained.

The serializer 42 receives the parallel print data Ch0n+1–Ch63n+1 for the cycle Cn+1 from the data setting circuit 41, and outputs the received data as ejection data A in series through its serial output terminal OUT when shift clock pulses SCK rise. The serial data Ch0n+1–Ch63n+1 from the serializer 42 are input in the serial input terminal IN1 of the first shift register 43.

The print data Ch0n–Ch63n for the cycle Cn have been stored in the first shift register 43, which outputs them as ejection data B in series through its serial output terminal OUT when the shift clock pulses SCK rise. The serial data Ch0n–Ch63n from this register 43 are input in the serial input terminal IN of the second shift register 44.

The print data Ch0n−1–Ch63n−1for the cycle Cn−1 have been stored in the second shift register 44, which outputs them as ejection data C in series through its serial output terminal OUT when the shift clock pulses SCK rise.

The transfer data generator 45 receives the serial ejection data A–C and the transfer data control signals TDC0–TDC7. The generator 45 then makes logical operations for each channel, and outputs stop pulse data SDn−1, which are transferred to the drive circuit 121.

During the stop pulse data transfer period, only the transfer data control signal TDC3 is made "1" and the other signals TDC0–TDC2 and TDC4–TDC7 are made "0". Consequently, only when a bit of data A is "0" and the associated bits of data B and C are "1", the AND gate 50 associated with the signal TDC3 outputs "1" while the other gates 50 output "0". In this case, the bit of stop pulse data SDn−1 output from the OR gate 51 is "1". That is to say, in this case, the bit of transfer data TD for a dot (B) is "1", which represents a stop pulse, if the dot succeeds a dot (C) and precedes no dot (A).

Thus, if there are print commands for the cycles Cn−1 and Cn for one of the channels, and if there is no print command for the cycle Cn+1 for this channel, the bit of stop pulse data SDn for the cycle Cn for this channel is, "1" to cancel the residual pressure wave vibration in the channel. The other combinations of the print commands for the cycles Cn−1, Cn and Cn+1 cause the bit of stop pulse data SDn to be "1".

The conditions for adding a stop pulse are not limited to the foregoing data combination, but arbitrary. In particular, depending on the temperature or other conditions at or in which the printer is used, it is possible to change one or more of the transfer data control signals TDC0–TDC7 so as to either add or omit a stop pulse as shown in Japanese Patent Laid-Open Publication No. H.9-48112. It is possible to change the logical operation expressions by modifying one or more of the logical circuits in the control circuit 122, or storing desired patterns of the transfer data control signals in the ROM 12 or the RAM 13. The transfer data control signals stored in the RAM 13 can be rewritten through the personal computer 26.

With reference to FIG. 6, the operation of the control circuit 122 during the ejection pulse data transfer period will be explained.

When the stop pulse data SDn−1 have been transferred, the print data Ch0n+1–Ch63n+1 have been stored in the first shift register 43. When shift clock pulses SCK rise, this register 43 outputs the stored data Ch0n+1–Ch63n+1 in series through its serial output terminal OUT. The serial data Chn+1 from this terminal OUT are input to the serial input terminal IN2 of the register 43.

During the ejection pulse data transfer period, the transfer data control signals TDC0, TDC1, TDC4 and TDC5 are made "0" Rand the other signals TDC2, TDC3, TDC6 and TDC7 are made "1". This, regardless of the states of the ejection data A and C, causes the ejection data B to be output from any of the AND gates 50 associated with the signals TDC2, TDC3, TDC6 and TDC7. Then, the OR gate 51 outputs the ejection data B as ejection pulse data.

Figure 7:
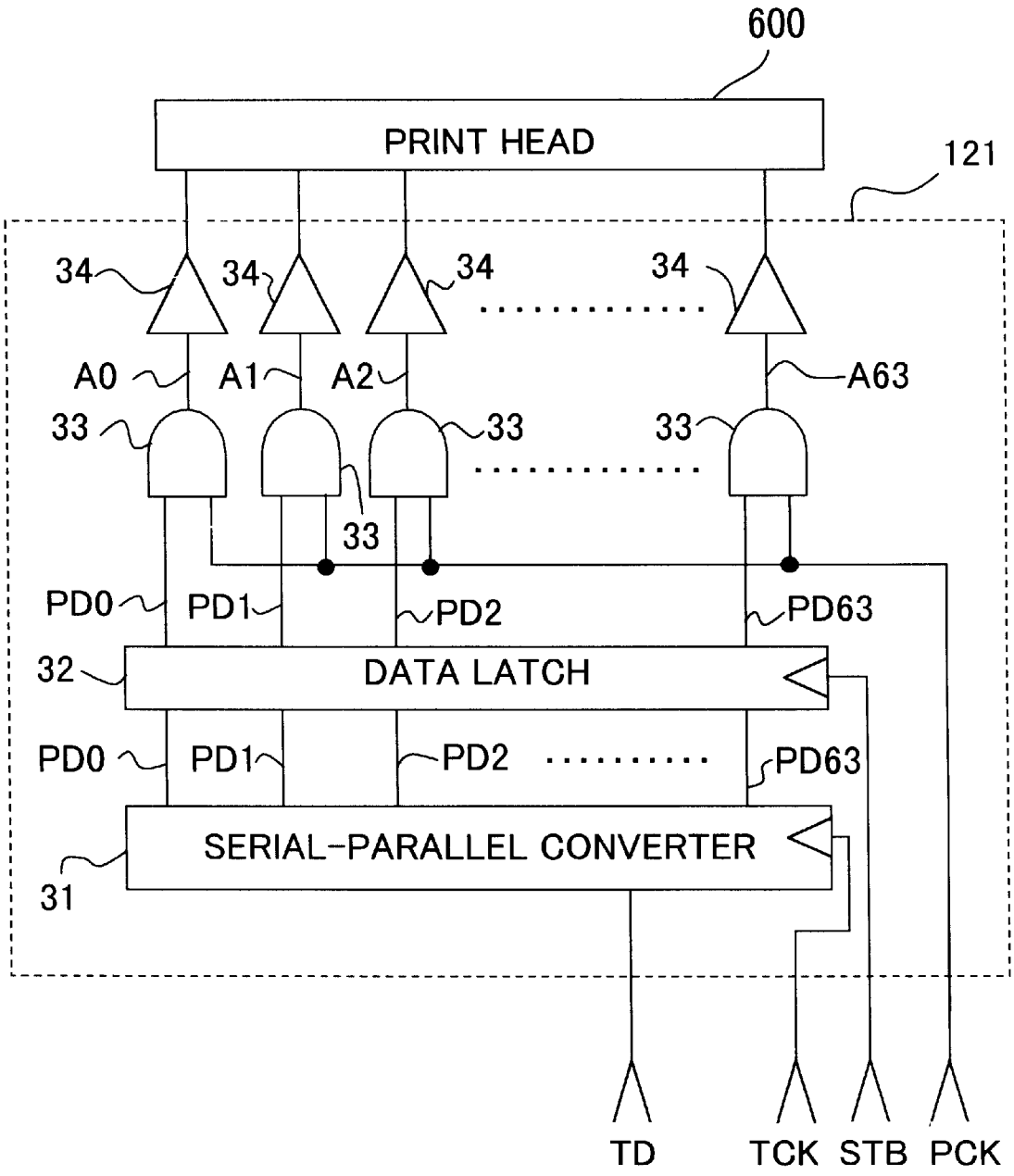
FIG. 7 is a block diagram of the drive circuit shown in FIG. 2.

With reference to FIG. 7, the drive circuit 121 includes a serial-parallel converter 31 and a data latch 32. The circuit 121 also includes 64 AND gates 33 and output circuits 34. The output circuits 34 are connected to the electrodes 619 in the respective channels 613 of the print head 600.

The converter 31 is a 64-bit shift register, which receives transfer data TD transferred in synchronism with the transfer clock TCK serially from the control circuit 122. When pulses of the transfer clock TCK rise, the converter 31 converts the received serial data TD into parallel data PD0–PD63.

When a pulse of the strobe signal STB from the control circuit 122 rises, the latch 32 latches the parallel data PD0–PD63.

The AND gates 33 output drive data A0–A63, which are the logical products of the parallel data PD0–PD63 from the latch 32 and a pulse of the print clock PCK from the control circuit 122.

On the basis of the drive data A0–A63, the output circuits 34 can generate a voltage which is suitable for the print head 600, and output it to the associated channel electrodes 619.

If the print head 600 did not have 64 channels, it would only be necessary for the bits of the converter 31, the AND gates 33, and the output circuits 34 to be equal in number to the channels of the head.

The parallel data PD0–PD63 from the converter 31 are associated with the respective channels 613 of the print head 600. Accordingly, the bits of the transfer data TD from the control circuit 122 and the print data Ch0–Ch63 in it are associated with the respective channels 613. In accordance with the bits of the transfer data TD and the print data Ch0–Ch63, the voltage can be generated for application to the electrodes 619 in the channels 613 to control the ejection of ink from the channels when ink is ejected and when the residual pressure wave vibration in the channels is canceled.

The same voltage is generated to eject ink and cancel the vibration.

With reference to FIG. 8, the operation of the apparatus according to this embodiment will be described.

In every print cycle, stop pulse data SD and ejection pulse data ED are transferred. The strobe signal STB includes pulses STBe for the ejection pulse data ED and pulses STBs for the stop pulse data SD. The print clock PCK includes pulses PCKe for the ejection pulse data ED and pulses PCKs for the stop pulse data SD. Pulses STBe, STBn, PCKe and PCKn are transferred in every print cycle.

In each print cycle, ejection of ink can be followed by cancellation of vibration. In other words, a print clock pulse PCKe is transferred and thereafter a print clock pulse PCKs is transferred in each cycle.

In the cycle Cn−1 , the stop pulse data SDn−1 for this cycle are transferred, and thereafter the ejection pulse data EDn for the next cycle Cn are transferred. In the cycle Cn, the stop pulse data SDn for this cycle are transferred, and thereafter the ejection pulse data EDn+1 for the next cycle Cn+1 are transferred.

In the cycle Cn−1 , the strobe pulse STBen−1 associated with the ejection pulse data EDn−1 (not shown) for this cycle are transferred, and thereafter the strobe pulse STBsn−1 associated with the stop pulse data SDn−1 for this cycle are transferred. In the next cycle Cn, the strobe pulse STBen associated with the ejection pulse data EDn for this cycle are transferred, and thereafter the strobe pulse STBsn associated with the stop pulse data SDn for this cycle are transferred.

In the cycle Cn−1 , the print clock pulse PCKen−1 associated with the ejection pulse data EDn−1 (not shown) for this cycle are transferred, and thereafter the print clock pulse PCKsn−1 associated with the stop pulse data SDn−1 for this cycle are transferred. In the next cycle Cn, the print clock pulse PCKen associated with the ejection pulse data EDn for this cycle are transferred, and thereafter the print clock pulse PCKsn associated with the stop pulse data SDn for this cycle are transferred.

With reference to FIG. 8, the operation of the drive circuit 211 will be explained.

If the print clock PCK is high in logical level, the output from each AND gate 33 depends on the associated output from the latch 32, that is, the associated bit of transfer data TD. If the print clock PCK is low in logical level, the output from the AND gates 33 is inhibited and low in logical level regardless of the output from the latch 32. In other words, the clock PCK functions as an enabling signal for the AND gates 33 to produce drive data A0–A63.

If one or more bits of the parallel data PD0–PD63 from the latch 32 are high in logical level when the print clock PCK is high in logical level, the drive data bit or bits from the associated AND gate or gates 33 are high in logical level. Then, the associated output circuit or circuits 34 generate a voltage, and output it to the electrodes 619 in the associated channel or channels 613 of the print head 600. If one or more bits of the parallel data PD0–PD63 from the latch 32 are low in logical level even when the print clock PCK is high in logical level, the drive data bit or bits from the associated AND gate or gates 33 are low in logical level. Then, the associated output circuit or circuits 34 generate no voltage.

Each print clock pulse PCKe rises at a point of time t1 and falls at a point of time t2. The width of each print clock pulse PCKe equals the one-way propagation delay time T. Each print clock pulse PCKs rises at a point of time t3 and falls at a point of time t4. The time "d" between the point t2 and the middle point tM between the points t3 and t4 is 2.5 times as long as the time T.

If a bit of the ejection pulse data ED for a certain print cycle is high in logical level, the rise of the print clock pulse PCKe at the point t1 in this cycle generates electric fields in the associated actuator walls 603, as shown in FIG. 25. The fields enlarge the associated channel 613 in volume, reducing the pressure in the channel. Then, ink flows into the channel 613. In the meantime, the enlarged volume generates pressure wave vibration. The pressure due to the vibration increases and reverses into positive pressure, which reaches its peak about when the one-way propagation delay time T has just passed.

When the print clock pulse PCKe falls at the point t2 in this cycle, the channel 613 decreases in volume, developing pressure. This pressure and the pressure which has reversed to a plus are added together. This develops relatively high pressure near the nozzle 618 in the channel 613, ejecting ink out through the nozzle. The ejected ink sticks to the sheet of printing paper P, forming an image on it.

After the point t3 in this cycle, the pressure in the channel 613 reverses from a plus to a minus. If the associated bit of the stop pulse data SD for this cycle is high in logical level, the rise of the print clock pulse PCKs at the point t3 in this cycle rapidly reduces the pressure which is still positive.

Before the point t4 in this cycle, the pressure in the channel 613 reverses to a minus. When the print clock pulse PCKs falls at the point t4 , the negative pressure increases rapidly. This cancels the pressure wave vibration, rapidly damping the vibration. The cancellation of the pressure wave vibration prevents ink from being ejected accidentally through the nozzle 618, and makes it possible to be ready earlier for the step in accordance with the next print command. It is therefore possible to form a more accurate image on the sheet P, and shorten the print cycles, thereby improving the print speed.

The width W of each print clock pulse PCKs is half (0.5) of the one-way propagation delay time T. The print clock pulses PCKs are generated to cancel the pressure wave vibration in the channel or channels 613. Besides, the width W is short and very different from a value which is an odd number of times as large as the time T. Therefore, the pulses PCKs enable no ink to be ejected from the channel or channels 613.

Thus, this embodiment makes it possible to switch securely between the execution and no execution of vibration cancellation in each print cycle, depending on whether there is a print command for one or each of the preceding and following cycles. When such selective switching is made, the control circuit 122 can accurately control the voltage application by the drive circuit 121 to electrodes 619.

The drive circuit 121 may be conventional. In this case, by constructing only the control circuit 122 as stated above, it is possible to provide an ink ejection apparatus which can switch between the execution and no execution of vibration cancellation. As stated above, the drive circuit 121, which is a one-chip IC, and the print head 600 form the head unit 508.

The unit 508 is mounted on the carriage 504, but the control circuit 122 is connected via the harness cable 28 to the drive circuit 2. It is therefore possible to realize this embodiment by replacing only the control circuit 22 of the conventional ink ejection apparatus (FIGS. 23–25) with the circuit 122 without modifying the head unit. This can lower remodeling costs.

Figure 9:
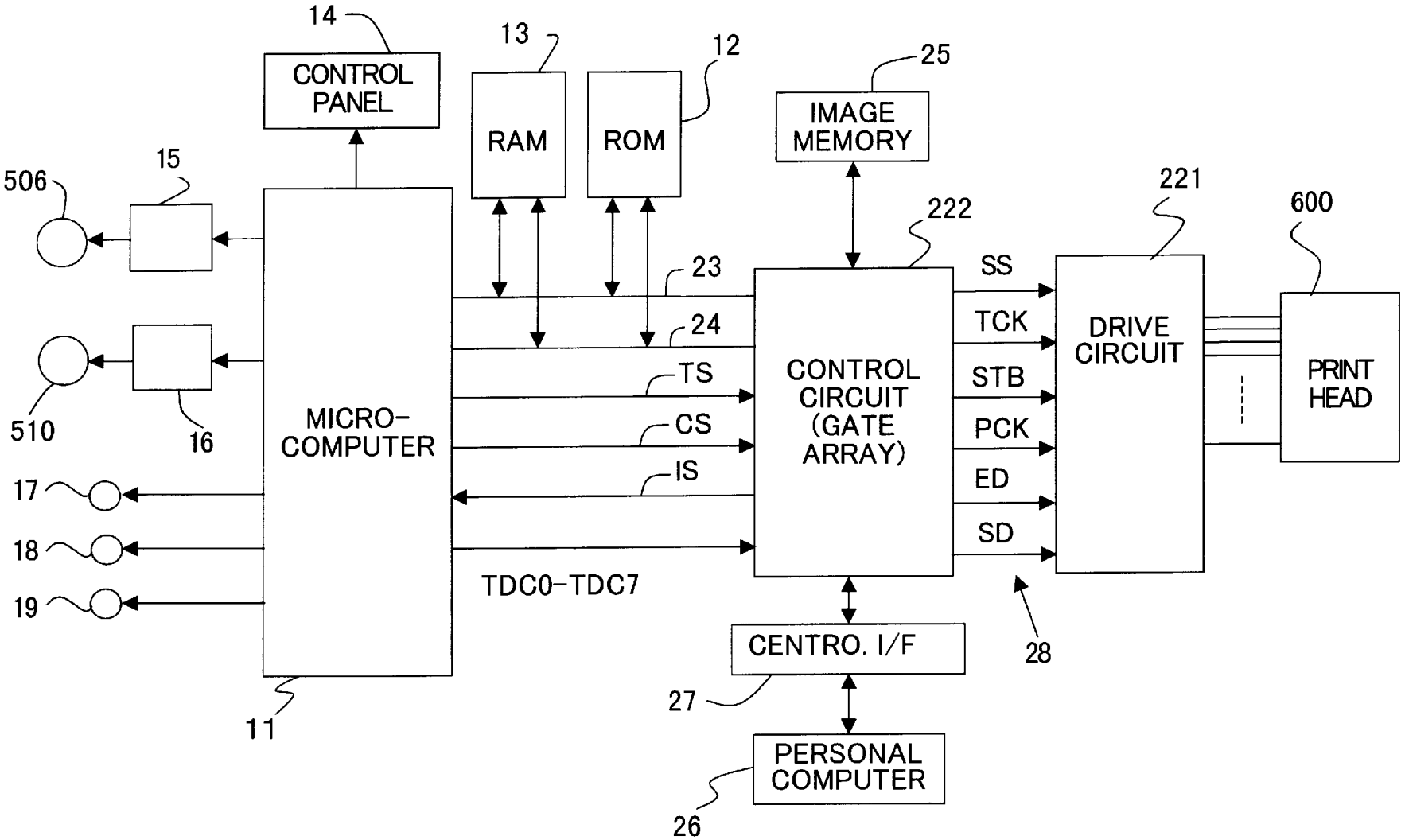
FIG. 9 is a block diagram of the electric system of the printer fitted with the apparatus according to a second embodiment of the invention.

FIG. 9 shows the electric system of the printer fitted with the apparatus according to the second embodiment. The basic structure of this printer is similar to the structure shown in FIG. 2 for the first embodiment, and includes a microcomputer 11, a control circuit 222 and a drive circuit 221. The two embodiments differ mainly as follows.

In accordance with a print timing signal TS and a control signal CS, the control circuit 222 generates and outputs to the drive circuit 221:

ejection pulse data ED on the ejection of ink from the channels 613 (FIGS. 23–25) for image formation on printing paper P on the basis of print data stored in the image memory 25;

stop pulse data SD on the cancellation of the residual pressure wave vibration in the channels 613 on the basis of print data stored in this memory 25; and a switching signal SS for switching the data ED and SD.

The microcomputer 11 outputs to the control circuit 222 eight transfer data control signals TDC0–TDC7 for controlling the data ED and SD. The signals TDC0–TDC7 can be changed as the need arises.

The drive circuit 221 switches the data ED and SD.

Figure 10:
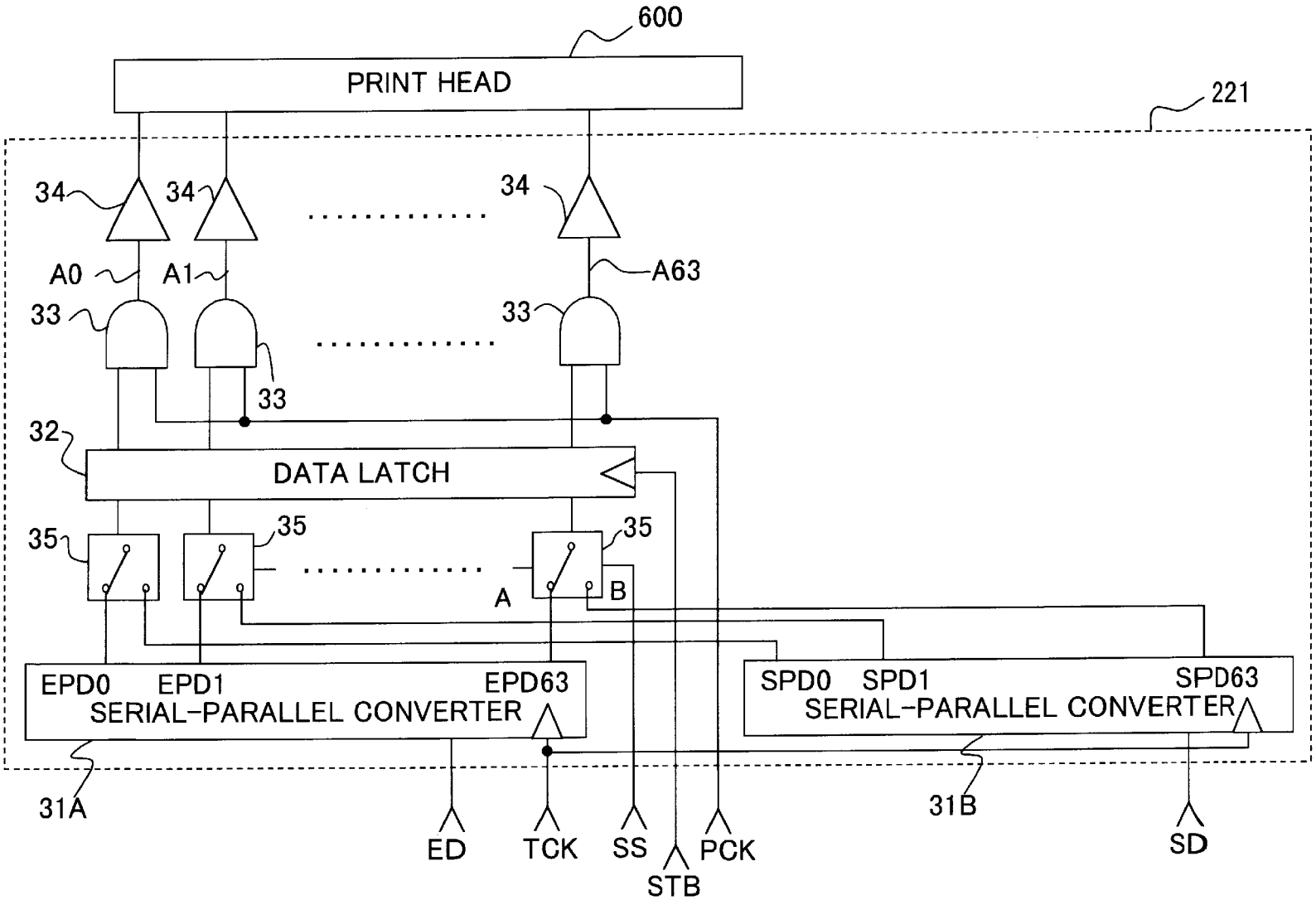
FIG. 10 is a block diagram of the drive circuit shown in FIG. 9.

With reference to FIG. 10, the drive circuit 221 includes a pair of serial-parallel converters 31A and 31B, each of which is a 64-bit shift register, 64 electronic switches 35 and a data latch 32. The circuit 221 also includes 64 AND gates 33 and output circuits 34. The latch 32, the AND gates 33 and the output circuits 34 are similar in structure to the counterparts of the first embodiment.

The converter 31A receives ejection pulse data ED transferred in series synchronously with the transfer clock TCK from the control circuit 222. When pulses of the clock TCK rise, the converter 31A converts the input serial data ED into parallel data EPD0–EPD63. The converter 31B receives stop pulse data SD transferred in series synchronously with the transfer clock TCK from the control circuit 222. When pulses of the clock TCK rise, the converter 31B converts the input serial data SD into parallel data SPD0–SPD63.

Each switch 35 changes over from one of its nodes A and B to the other in accordance with the switching signal SS transferred from the control circuit 222. If the switches 35 change over to their respective nodes A, they select the parallel data EPD0–EPD63. If the switches 35 change over to their respective nodes B, they select the parallel data SPD0–SPD63. The switches 35 output the selected data to the latch 32.

Figure 11:
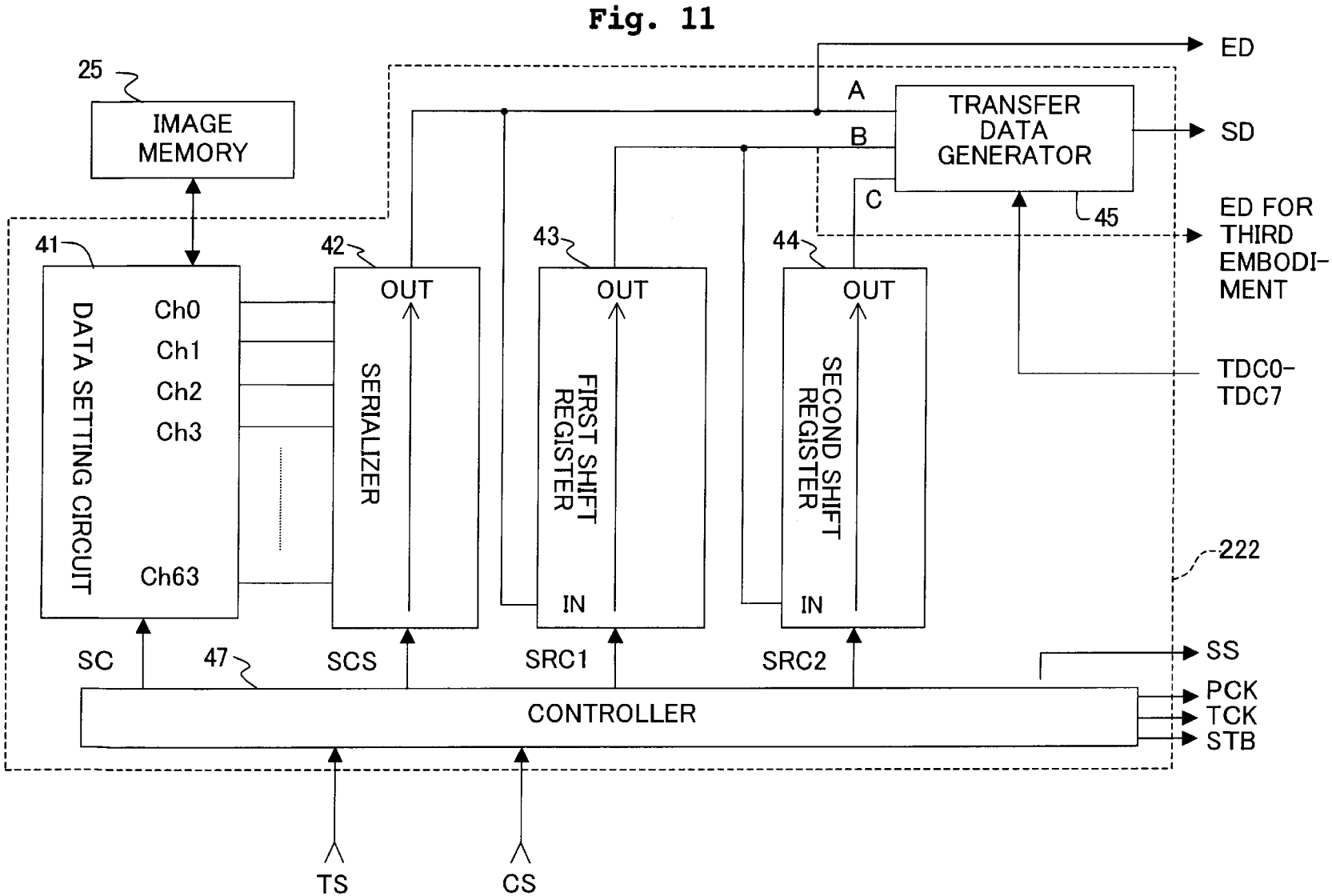
FIG. 11 is a block diagram of the control circuit shown in FIG. 9.

With reference to FIG. 11, the basic structure of the control circuit 222 is similar to the counterpart of the circuit 122 of the first embodiment, and consists of a data setting circuit 41, a serializer 42, a first shift register 43, a second shift register 44, a transfer data generator 45 and a controller 47. The generator 45 is identical with the counterpart shown in FIG. 4A.

This serializer 42 outputs serial print data Ch0–Ch63 as ejection data A through its serial output terminal OUT. The data A are input as ejection pulse data ED to the serial-parallel converter 31A of the drive circuit 221.

This first shift register 43 outputs serial print data Ch0–Ch63 as ejection data B through its serial output terminal OUT to the transfer data generator 45 and the second shift register 44, without feeding them back to itself.

This second shift register 44 outputs serial print data Ch0–Ch63 as ejection data C through its serial output terminal OUT to the transfer data generator 45.

This transfer data generator 45 outputs stop pulse data SD on the basis of the ejection data A–C and the transfer data control signals TDC0–TDC7 from the microcomputer 11. As is the case with the first embodiment, the signals TDC0–TDC7 might otherwise be output from the controller 47.

As is the case with the first embodiment, the controller 47 generates a strobe signal STB, a transfer clock TCK and a print clock PCK. The controller 47 also generates the switching signal SS. These signals are input to the drive circuit 221.

Figure 12:
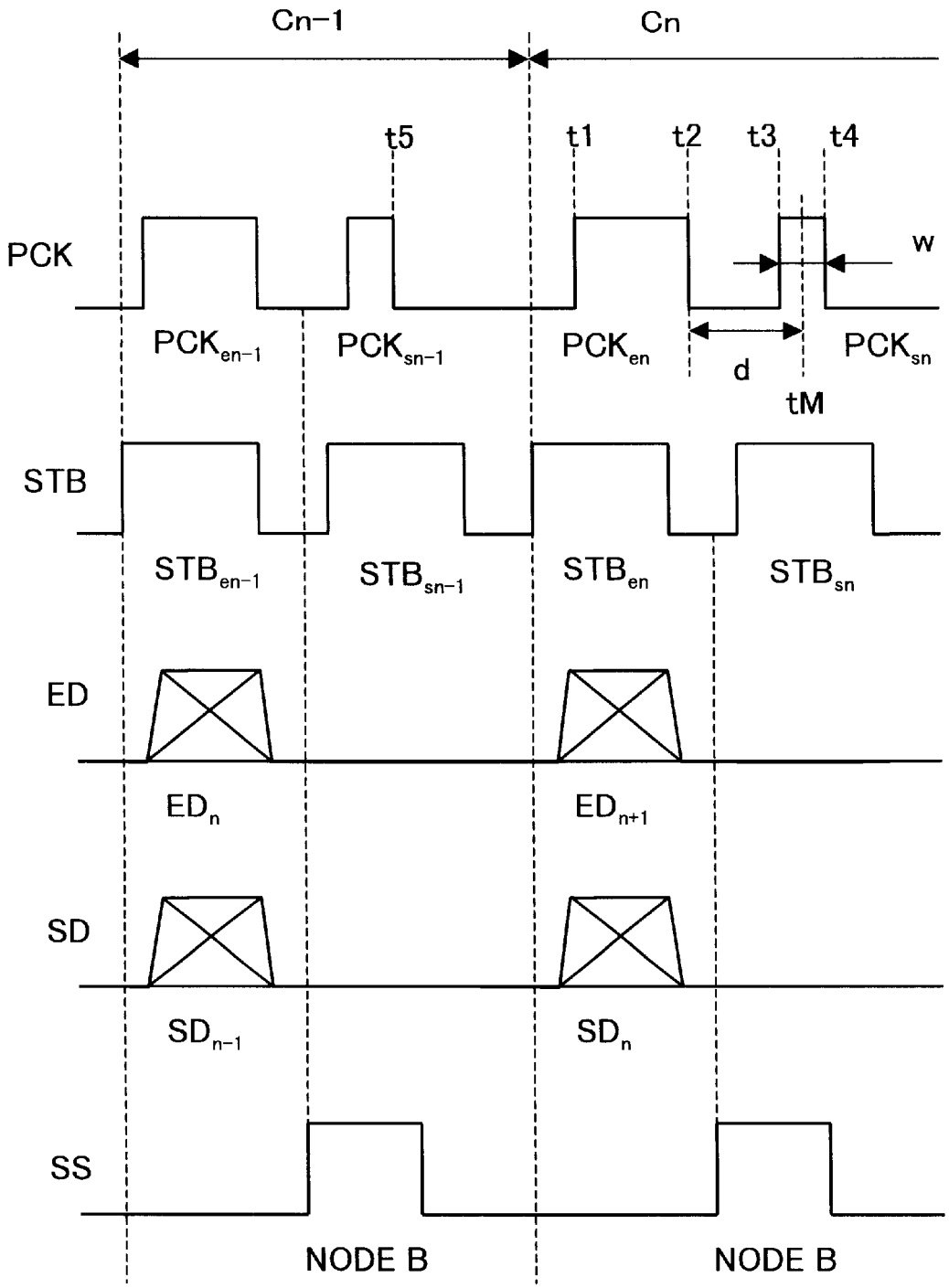
FIG. 12 is a time chart of signals and data in this embodiment.

With reference to FIG. 12, the operation of the apparatus according to the second embodiment will be explained. The print clock PCK and the strobe signal STB are similar to the counterparts of the first embodiment.

The ejection pulse data EDn for a print cycle Cn and the stop pulse data SDn−1 for the preceding cycle Cn−1 are transferred at the same time in the cycle Cn−1. The ejection pulse data EDn+1 for the following cycle Cn+1 (not shown) and the stop pulse data SDn for the cycle Cn are transferred at the same time in the cycle Cn.

In the cycle Cn−1, the print clock pulse PCKen−1 associated with the ejection pulse data EDn−1 (not shown) for this cycle is transferred, and thereafter the print clock pulse PCKsn−1 associated with the stop pulse data SDn−1 for this cycle is transferred. In the cycle Cn, the print clock pulse PCKen associated with the ejection pulse data EDn for this cycle is transferred, and thereafter the print clock pulse PCKsn associated with the stop pulse data SDn for this cycle is transferred.

The switching signal SS is transferred in association with the strobe signal STB. In each of the cycles Cn−1 and Cn, the switching signal SS switches the switches 35 of the drive circuit 221 to the nodes B when the strobe pulse STBsn−1 or STBsn for the associated stop pulse data SDn−1 or SDn is transferred. Otherwise, in each of the cycles Cn−1 and Cn, the signal SS switches the switches 35 to the nodes A.

When the switches 35 are switched to the nodes A in accordance with the switching signal SS, the latch 32 latches parallel data EPD0–EPD63 output from the converter 31A. When the switches 35 are switched to the nodes B, the latch 32 latches parallel data SPD0–SPD63 output from the converter 31B.

When the ejection pulse data EDn−1 for the cycle Cn−1 are latched in the latch 32, the stop pulse data SDn−1 for this cycle are stored in the converter 31B, and the ejection pulse data EDn for the next cycle Cn are stored in the converter 31A. After the ejection pulse data EDn−1 are output, the associated stop pulse data SDn−1 are output, and subsequently the next ejection pulse data EDn are output.

The latched data are output synchronously with the print clock PCK to the print head 600 for ejection of ink and cancellation of vibration.

A time chart (not shown) for the control circuit 222 would be similar to FIG. 5. This chart would be a time chart for the period when the ejection pulse data EDn+1 and the stop pulse data SDn are transferred as transfer data in the cycle Cn shown in FIG. 12.

Figure 13:
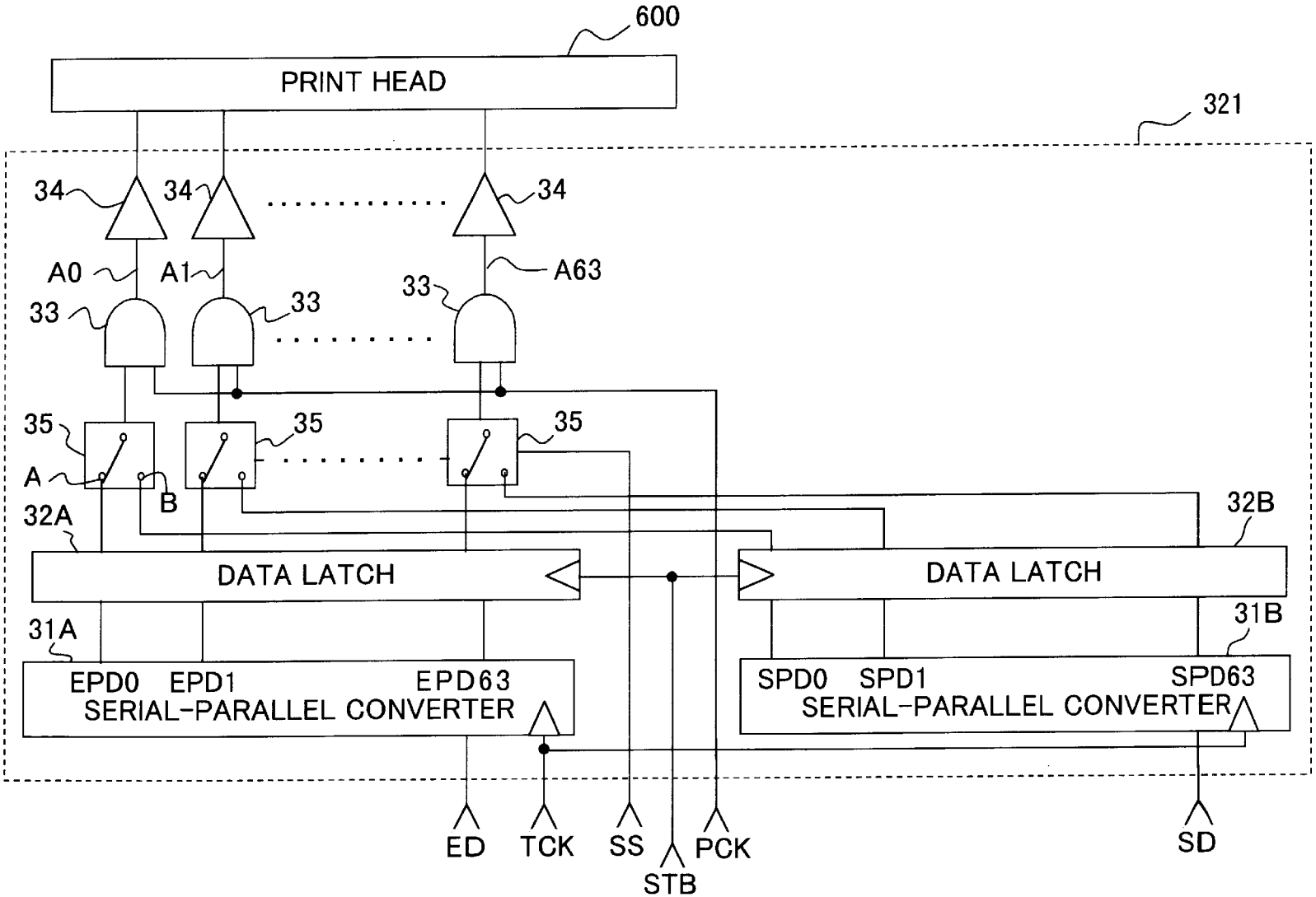
FIG. 13 is a block diagram of the drive circuit of the apparatus according to a third embodiment of the invention.

FIG. 13 shows the drive circuit 321 of the apparatus according to the third embodiment. The circuit 321 is a slight modification of the circuit 221 shown in FIG. 10 for the second embodiment. The circuit 321 includes a pair of data latches 32A and 32B, which are associated with serial-parallel converters 31A and 31B, respectively. Electronic switches 35 can selectively output data from one of the latches 32A and 32B to AND gates 33.

Figure 14:
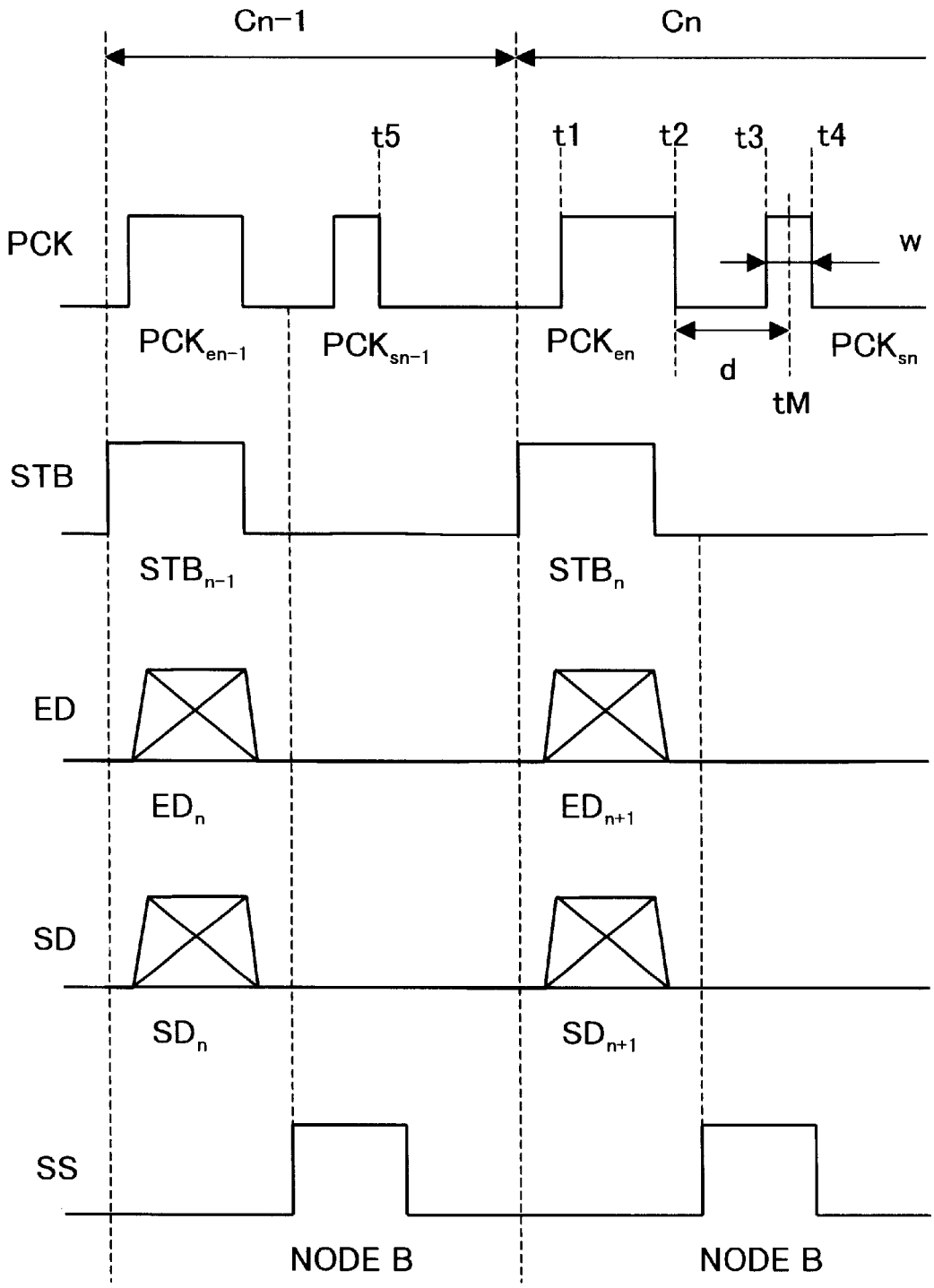
FIG. 14 is a time chart of signals and data in this embodiment.

FIG. 14 is a time chart of the print clock PCK, the strobe signal STB, the ejection pulse data ED, the stop pulse data SD and the switching signal SS in this embodiment.

As shown in FIG. 14, the ejection pulse data EDn and the stop pulse data SDn for a print cycle Cn are transferred at the same time in the preceding cycle Cn−1. In the cycle Cn, the ejection pulse data EDn+1 and the stop pulse data SDn+1 for the following cycle Cn+1 (not shown) are transferred at the same time. As shown with a broken line in FIG. 11, the ejection pulse data ED transferred to the drive circuit 321 are the serial data B from the first shift register 43 of the control circuit 222.

Transferred in the cycle Cn−1 are the strobe pulse STBn−1 associated with the ejection pulse data EDn−1 (not shown) and the stop pulse data SDn−1 (not shown) for this cycle. Transferred in the cycle Cn are the strobe pulse STBn associated with the ejection pulse data EDn and the stop pulse data SDn for this cycle. The switching signal SS is transferred in association with the print clock PCK.

In each of the print cycles Cn−1 and Cn, the switches 35 of the drive circuit 321 are switched to their respective nodes B in accordance with the switching signal SS when the print clock pulse ICKsn−1 or ICKsn for the associated stop pulse data SDn−1 or Sdn is transferred. Otherwise, the switches 39 are switched to their respective nodes A in accordance with the signal SS.

When the switches 35 are switched to their nodes A, the AND gates 33 of the drive circuit 321 receive the parallel data EPD0–EPD63 output from the converter 31A and latched by the latch 32A. When the switches 35 are switched to their nodes B, the gates 33 receive the parallel data SPD0–SPD63 output from a the converter 31B and latched by the latch 32B.

The data latched in the latches 32A and 32B are output to the print head 600 synchronously with the print clock PCK to eject ink from one or more of the channels 613 and to cancel the residual pressure wave vibration in the channel or channels, as is the case with the foregoing embodiments.

A time chart for the period when the ejection pulse data EDn and the stop pulse data SDn are transferred would be equivalent to FIG. 5.

Thus, the control circuit 222 generates the serial ejection pulse data EDn and the serial stop pulse data SDn for the cycle Cn at the same time. The serial data EDn and SDn are transferred at the same time to the drive circuit 321, where the converters 31A and 31B convert the serial data EDn and SDn, respectively, at the same time into parallel data EPD0–EPD63 and SPD0–SPD63, respectively. The parallel data EPD0–EPD63 and SPD0–SPD63 are output to the latches 32A and 32B, respectively, where they are latched at the same time in accordance with the strobe signal STB. The switches 35 change over in accordance with the switching signal SS associated with the print clock PCK. The switches 35 output either the latched data EPD0–EPD63 or the latched data SPD0–SPD63 to the AND gates 33, which output drive data A0–A63 in synchronism with the print clock PCK.

Therefore, as shown in FIG. 14, it is possible to shorten the time interval between the point t5 when the print clock pulse PCKsn−1 for the stop pulse data SDn−1 falls and the point t1 when the print clock pulse PCKen for the ejection pulse data EDn rises. It is also possible to shorten the time interval between the point t2 when this pulse PCKen falls and the point t3 when the print clock pulse PCKsn for the stop pulse data SDn rises. Consequently, this embodiment can further shorten the period of each print cycle in comparison with the second embodiment. This improves the print speed further.

Figure 15:
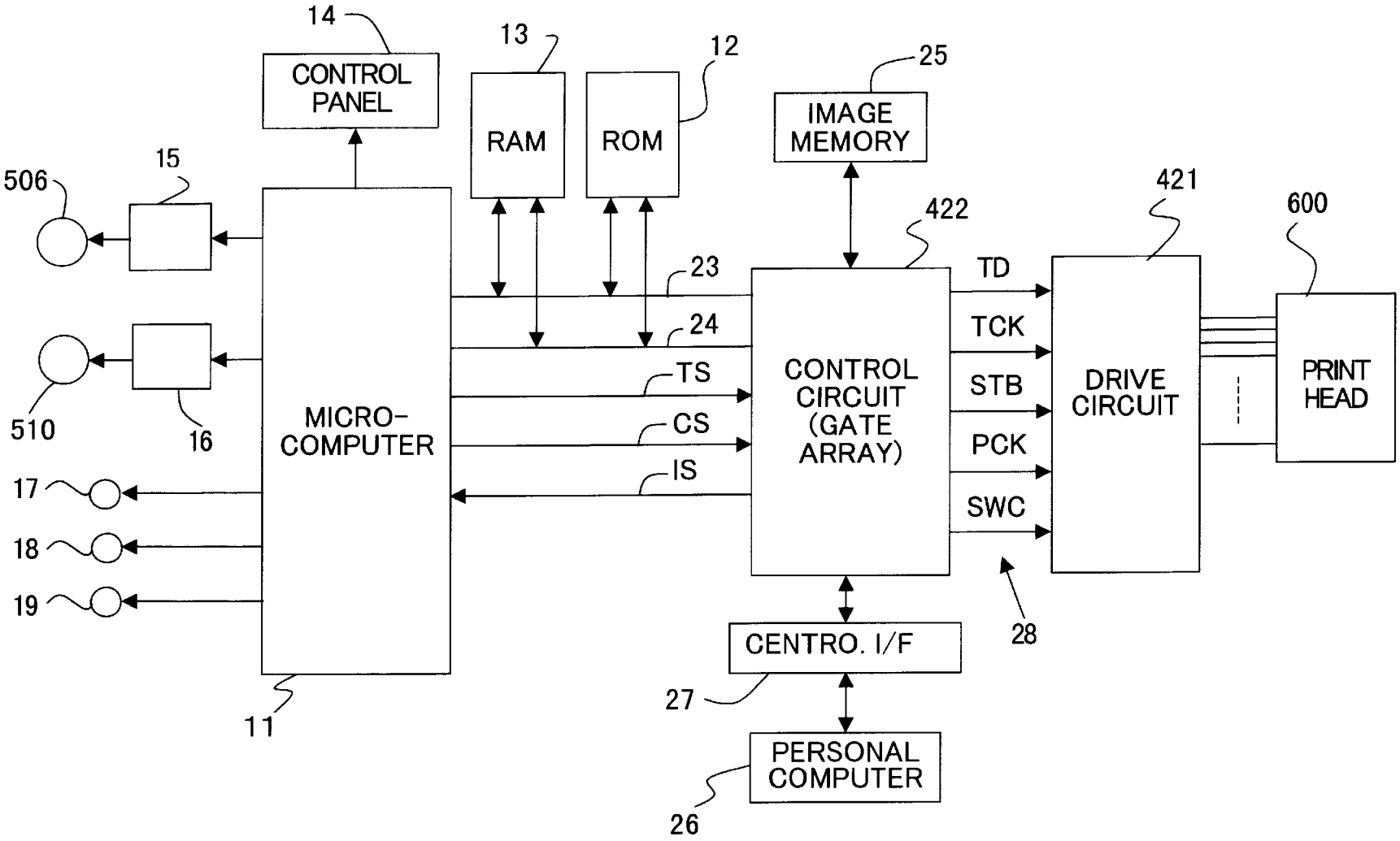
FIG. 15 is a block diagram of the electric system of the printer fitted with the apparatus according to a fourth embodiment of the invention.

FIG. 15 shows the electric system of the printer fitted with the apparatus according to the fourth embodiment. The basic structure of this printer is similar to the counterpart of the first embodiment, and includes a microcomputer 11, a conventional control circuit 422 and a drive circuit 421. The two embodiments differ mainly as follows.

Additional pulses for vibration cancellation are generated by the drive circuit 421, not the control circuit 422. The control circuit 422 outputs, to the drive circuit 421, eight switching control signals SWC0–SWC7 for switching print data combinations, in place of the transfer data control signals TDC0–TDC7 for determining the condition for vibration cancellation.

Figure 16:
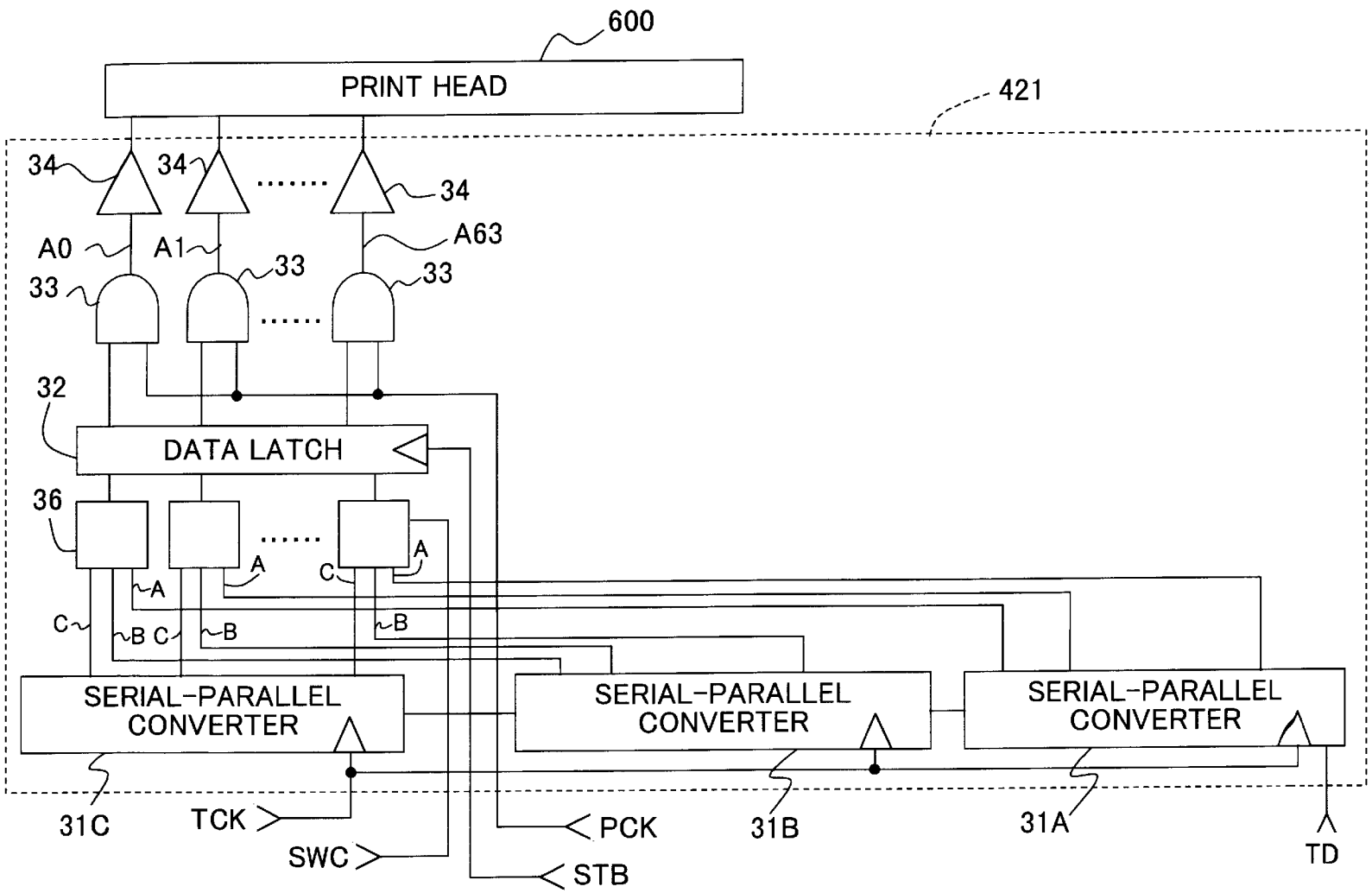
FIG. 16 is a block diagram of the drive circuit shown in FIG. 15.

With reference to FIG. 16, the drive circuit 421 includes three serial-parallel converters 31A, 31B and 31C, each of which is a 64-bit shift register, 64 pulse data generators 36 and a data latch 32. The circuit 421 also includes 64 AND gates 33 and output circuits 34.

The converter 31A receives transfer data TD transferred in series synchronously with a transfer clock TCK from the control circuit 422. When pulses of this clock TCK rise, the converter 31A converts the input serial data TD into parallel data A. The converter 31A outputs the input data TD in series to the converter 31B. When transfer clock pulses TCK rise, the converter 31B converts the input serial data TD into parallel data B, and outputs the data TD in series to the converter 31C. When transfer clock pulses TCK rise, the converter 31C receives the serial data TD in series from the converter 31B, and converts them into parallel data C.

Each pulse data generator 36 includes logical circuits, and functions as a device for generating additional pulse data. In accordance with the switching control signals SWC0–SWC7 from the control circuit 422, the generators 36 make logical operations of the parallel data A, B and C to generate ejection pulse data for ejection of ink and stop pulse data for cancellation of vibration. The signals SWC0–SWC7 designate a condition for generating a stop pulse, that is to say, one or more combinations of consecutive print pulse data. These signals may be determined depending on temperature or other conditions.

The data latch 32 latches stop pulse data and ejection pulse data in order when pulses of the strobe signal STB from the control circuit 422 rise. The latch 32 outputs the latched data to the AND gates 33.

Each AND gate 33 outputs a bit of drive data A0–A63, which is the logical product of the associated bit of the stop pulse data or the ejection pulse data and the print clock PCK from the control circuit 422.

On the basis of each bit of the drive data A0–A63, the associated output circuit 34 can generate voltage suitable for the print head 600. The circuit 34 outputs the voltage to the electrodes 619 in the associated channel 613 of the head 600.

The parallel data A, B or C from each of the converters 31A–31C are associated with the respective channels 613. Therefore, the stop pulse data and the ejection pulse data from the generators 36 are associated with the respective channels 613.

Each pulse data generator 36 is equivalent to the transfer data generator 45 shown in FIG. 4A. The switching control signals SWC0–SWC7 are equivalent to the transfer data control signals TDC0–TDC7 (FIGS. 4A and 4B). The AND gates 50 (FIG. 4A) of each generator 36 receive the associated parallel data A–C from the converters 31A–31C. Similarly to the first embodiment, the gates 50 output the logical products of the input data A–C and signals SWC0–SWC7. The OR gate 51 (FIG. 4A) of each generator 36 outputs stop pulse data and ejection pulse data. In other words, each generator 36 outputs stop pulse data or ejection pulse data in accordance with the signals SWC0–SWC7. By suitably selecting the logical level of each of the signals SWC0–SWC7, similarly to the first embodiment, it is possible to output any of the data A–C or a signal based on any combination of them.

Figure 17:
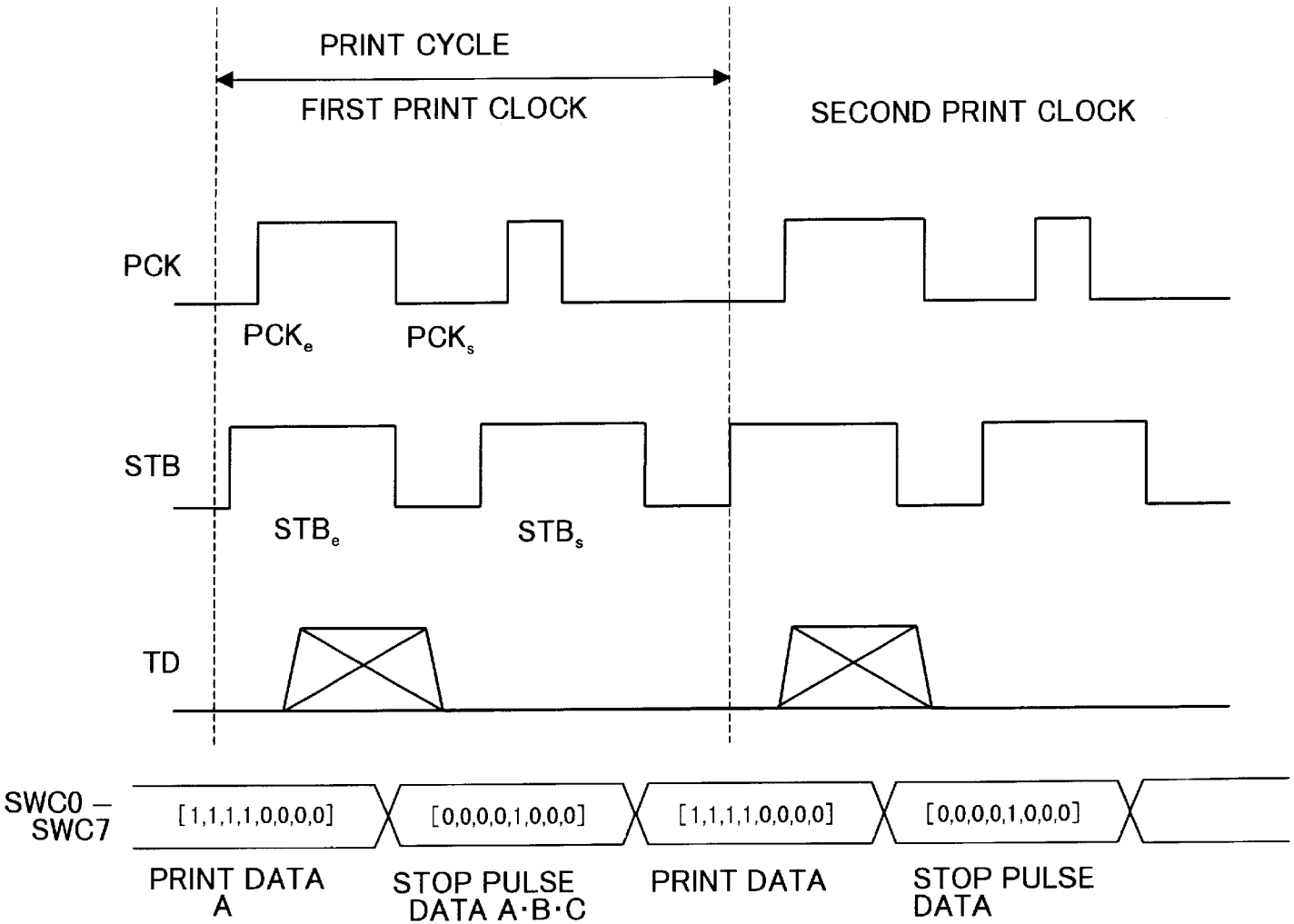
FIG. 17 is a time chart of signals and data in this embodiment.

With reference to FIG. 17, the operation of the apparatus according to the fourth embodiment will be explained.

Transfer data TD are transferred in every print cycle. Stop pulse data and ejection pulse data from the generators 36 are transferred in association with the strobe signal STB and the print clock PCK in each print cycle.

When transfer clock pulses TCK rise in each print cycle, transfer data TD are transferred in series from the converter 31A to the converter 31B and from the converter 31B to the converter 31C, and shifted in each of them by one bit at a time.

After the transfer data TD for one print cycle are transferred, the parallel data B from the converter 31B may be the ejection pulse data for the "n"th printing. In this case, the parallel data A from the converter 31A are the ejection pulse data for the "n+1"th printing, and the parallel data C from the converter 31C are the ejection pulse data for the "n−1"th printing.

The switching control signals SWC0–SWC7 are transferred in association with the strobe signal STB. In each print cycle, the print clock pulse PCKe associated with the ejection pulse data for this particular cycle is transferred, and thereafter the print clock pulse PCKs associated with the stop pulse data for the cycle is transferred. In each print cycle, the strobe pulse STBe for the ejection pulse data and the strobe pulse STBs for the stop pulse data are transferred in succession.

The pulse data generators 36 receive the parallel data A C and the switching control signals SWC0–SWC7, and make logical operations. First in each print cycle, SWC0–SWC3 are made "0" and SWC4–SWC7 are made "1". Consequently, regardless of the data B and C, the OR gates 51 (FIG. 4A) of the generators 36 output ejection pulse data which are identical with the data A stored in the converter 31A. After the strobe pulse STBe for the ejection pulse data rises and the latch 32 latches these data, the data in the converters 31A–31C shift so that the new transfer data TD and the data A and B become new data A–C, respectively. Thereafter, only the control signal SWC3 is made "1" and the other signals SWC0–SWC2 and SWC4–SWC7 are made "0". Consequently, the AND gate 50 associated with the signal SWC3 of each generator 36 outputs "1" only when the associated bit of data A is "0" and the associated bits of data B and C are "1". In this case, the stop pulse data bit for a dot (B) is "1" for addition of a stop pulse if the dot succeeds a dot (C) and precedes no dot (A). The stop pulse data synthesized by the generators 36 are latched by the latch 32 when the strobe pulse STBs rises.

Similarly to the foregoing embodiments, the AND gates 33 of the drive circuit 421 output drive data A0–A63 to the respective output circuits 34 in accordance with the conditions of the latch 32 and the print clock PCK.

Thus, by constructing the drive circuit 421 as stated above, and by using the conventional control circuit 422, which generates no stop pulse data, it is possible to provide an ink ejection apparatus which can switch between the execution and no execution of the vibration cancellation.

Figure 18:
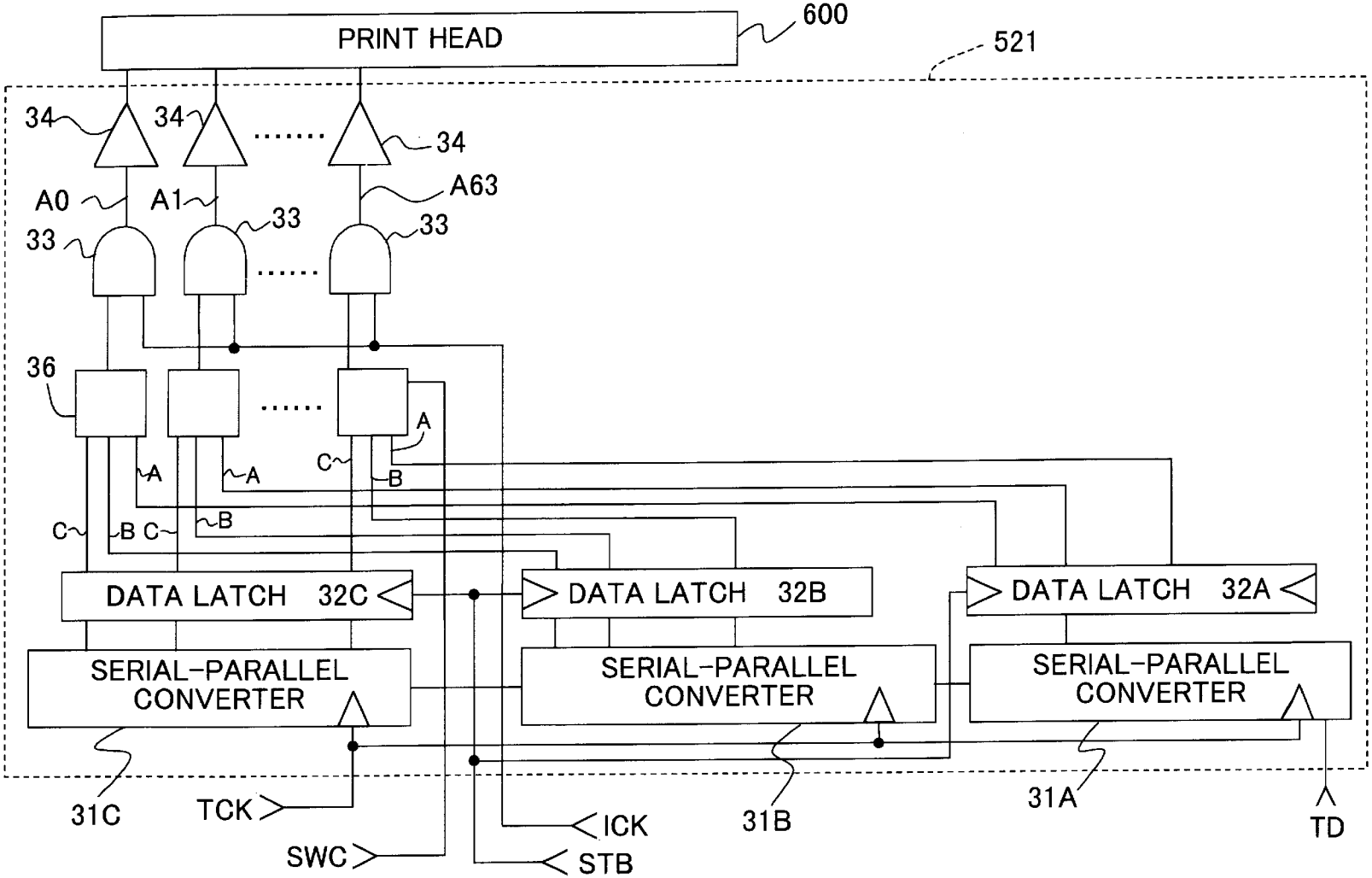
FIG. 18 is a block diagram of the drive circuit of the apparatus according to a fifth embodiment of the invention.

FIG. 18 shows the drive circuit 521 of the apparatus according to the fifth embodiment. This circuit 521 is a slight modification of the circuit 421 shown in FIG.16 of the fourth embodiment. The circuit 521 includes three serial-parallel converters 31A, 31B and 31C, which are associated with three data latches 32A, 32B and 32C, respectively. The circuit 521 also includes 64 pulse data generators 36, AND gates 33 and output circuits 34.

When a pulse of the strobe signal STB transferred from the control circuit 422 (FIG. 15) rises, the latches 32A–32C latch parallel data output from the converters 31A–31C, respectively.

The generators 36 are identical with the counterparts shown in FIG. 16. The generators 36 output the logical products of the switching control signals SWC0–SWC7 from the control circuit 422 and the parallel data A–C from the latches 32A–32C, respectively. The products are ejection pulse data and stop pulse data, which are input to the AND gates 33.

Figure 19:
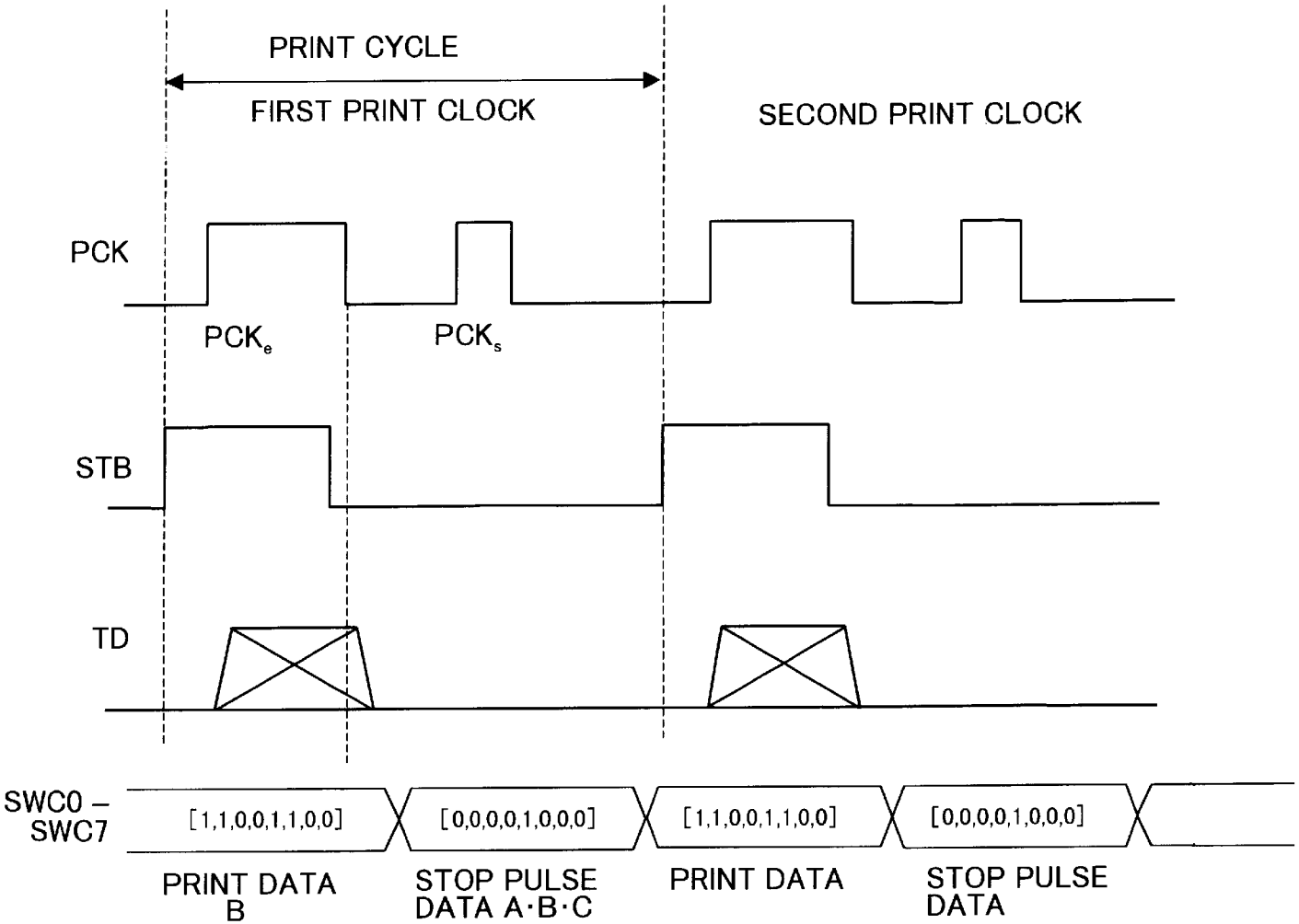
FIG. 19 is a time chart of signals and data in this embodiment.

With reference to FIG. 19, the operation of the drive circuit 521 will be explained.

The converters 31A–31C operate similarly to the counterparts of the foregoing embodiment. When a strobe pulse STB rises, the latches 32A–32C latch print data output from the converters 31A–31C, respectively. First in each print cycle, the switching control signals SWC0, SWC1, SWC4 and SWC5 are made "0" and the other signals SWC2, SWC3, SWC6 and SWC7 are made "1". This makes the generators 36 output the parallel data B as ejection pulse data to the AND gates 33. The gates 33 output the logical products of the ejection pulse data and the associated print clock pulse PCKe to the output circuits 34.

Subsequently, with the latched data A–C held, only the switching control signal SWC3 is made "1" and the other signals SWC0–SWC2 and SWC4–SWC7 are made "0". Consequently, the AND gate 50 (FIG. 4A) associated with the signal SWC3 of each pulse data generator 36 outputs "1" only if the associated data bit A is "0" and the associated data bits B and C are "1". Thus, the generators 36 output stop pulse data to the AND gates 33, which output the logical products of these data and the associated print clock pulse PCKs to the output circuits 34.

Thus, in the drive circuit 521, the parallel data from the serial-parallel converters 31A–31C are latched once in the data latches 32A–32C, respectively. In accordance with the switching control signals SWC0–SWC7 associated with the print clock PCK, the output from the pulse data generators 36 is switched between ejection pulse data and stop pulse data. The switched data are input to the AND gates 33. It is therefore possible to shorten the time interval between the point when the print clock pulse PCKs associated with the stop pulse data for each print cycle falls and the point when the print clock pulse PCKe associated with the ejection pulse data for the next cycle rises. It is also possible to shorten the time interval between the point when the print clock pulse PCKe associated with the ejection pulse data for each cycle falls and the point when the print clock pulse PCKs associated with the stop pulse data for this cycle rises. This can shorten the period of each cycle in comparison with the fourth embodiment, and improve the print speed further.

Figure 20:
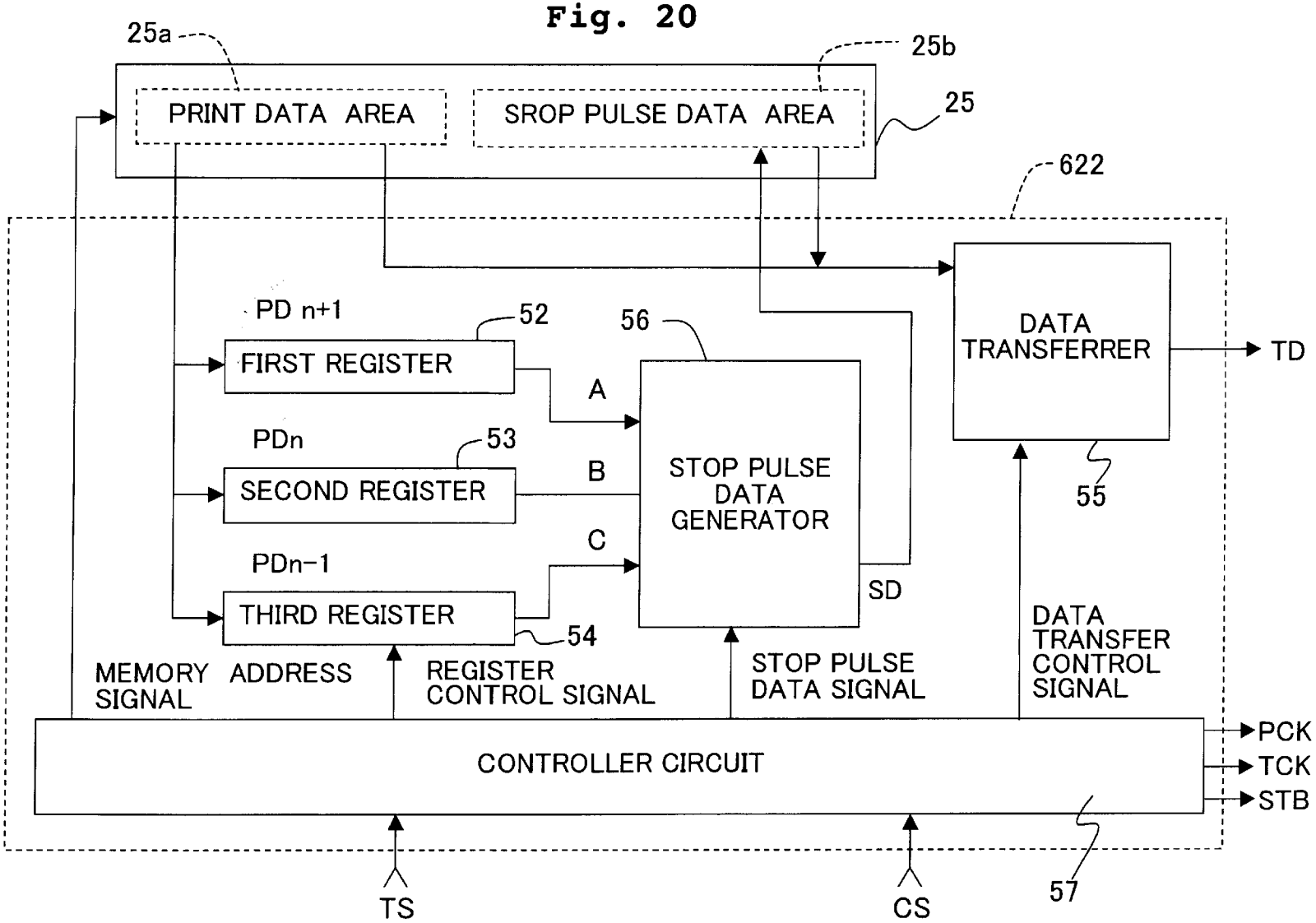
FIG. 20 is a block diagram of the control circuit of the apparatus according to a sixth embodiment of the invention.

FIG. 20 shows the control circuit 622 of the printer fitted with the apparatus according to the sixth embodiment. The electric system of this printer is similar to the system shown in FIG. 2. The printer includes a drive circuit (not shown) which is similar to the circuit 121 shown in FIG. 7. The printer also includes a microcomputer 11 (FIG. 2), which generates a print timing signal TS and a control signal CS.

The control circuit 622 includes a first register 52, a second register 53 and a third register 54 as three devices for storing data. The circuit 622 also includes a stop pulse data generator 56 as a device for generating additional pulse data, a data transferor 55 and a controller 57.

In accordance with the print timing signal TS and the control signal CS, the controller 57 generates a memory address signal, a register control signal, eight stop pulse data control signals and a data transfer control signal for controlling the memory 25, the registers 52–54, the generator 56 and the transferor 55, respectively. The controller 57 also generates a strobe signal STB, a transfer clock TCK and a print clock PCK f or synchronism with transfer data TD.

As shown in FIG. 20, the printer includes an image memory 25, which has a print data area 25*a* and a stop pulse data area 25*b*.

Print data PD stored in the area 25*a* of the memory 25 are read out in series by one byte at a time in the printing direction, and input to each of the registers 52–54. When the print data PDn for a print cycle Cn are stored in the second register 53, the print data PDn−1 for the preceding cycle Cn−1 are stored in the third register 54, and the print data PDn+1 for the following cycle Cn+1 are stored in the first register 52. In accordance with the register control signal, the registers 52–54 output the stored data as serial print data A–C, respectively, to the stop pulse data generator 56.

The stop pulse data generator 56 includes logical circuits, and is identical with the transfer data generator shown in FIG. 4A of the first embodiment. The generator 56 makes logical operations of the print data A–C from the registers 52–54 and the stop pulse data control signals SPC0–SPC7 from the controller 57. The signals SPC0–SPC7 are equivalent to the transfer data control signals TDC0–TDC7 (FIGS. 4A and 4B). The generator 56 generates serial stop pulse data SD, which are stored in the stop pulse data area 25*b* of the memory 25.

The data transferor 55 reads out print data PD and stop pulse data SD alternately from the areas 25*a* and 25*b* of the image memory 25, and outputs transfer data TD in series. The transfer data TD consist of ejection pulse data ED for ejection of ink from one or more of the channels 613 of the print head 600 and stop pulse data SD for cancellation of the residual pressure wave vibration in the channel or channels.

The operation of this apparatus will be explained.

A time chart of the print clock PCK, the strobe signal STB and the transfer data TD would be identical with FIG. 8 for the first embodiment.

Figure 21:
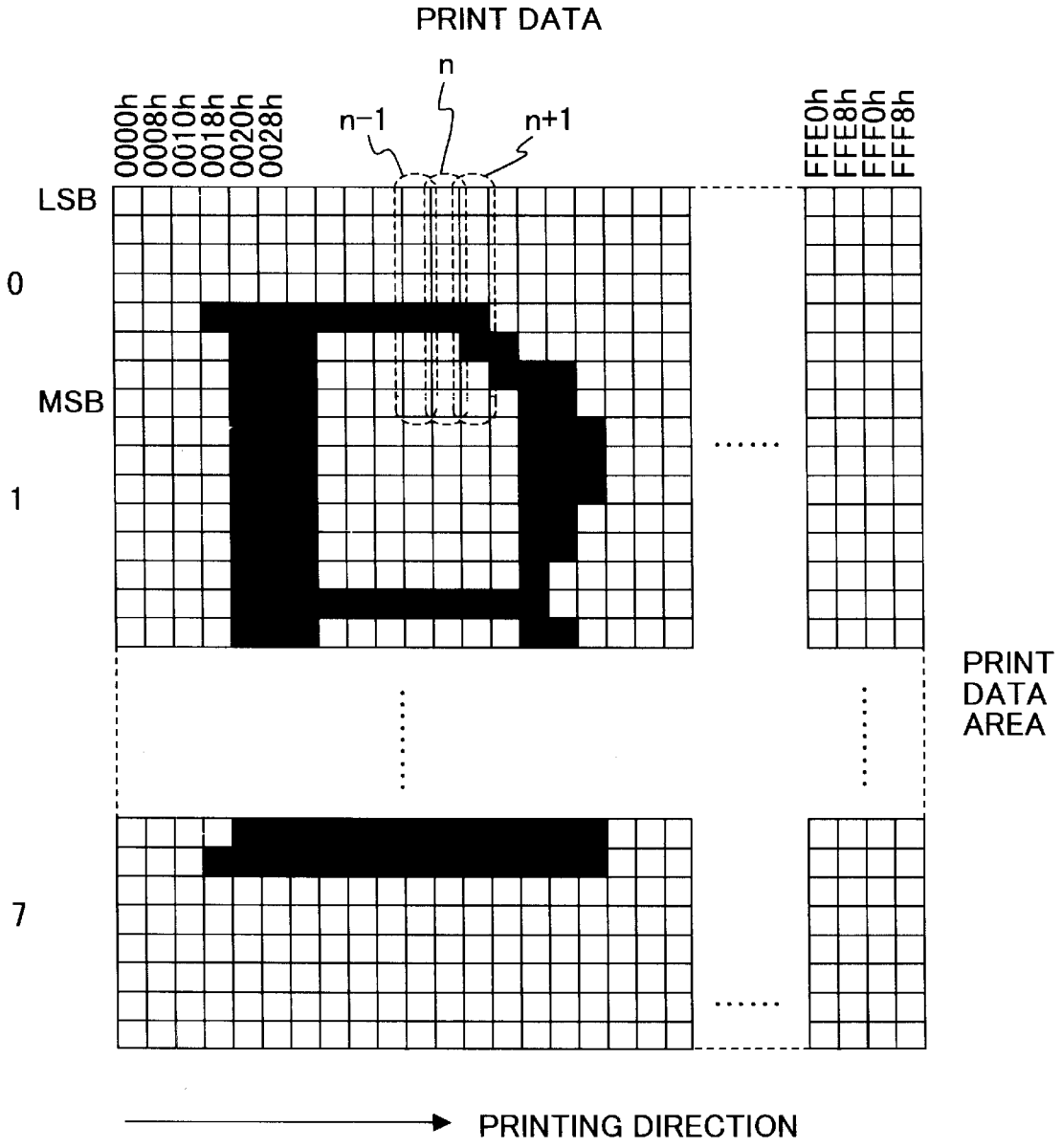
FIG. 21 is an image map of the print data area in the image memory of this apparatus.
Figure 22:
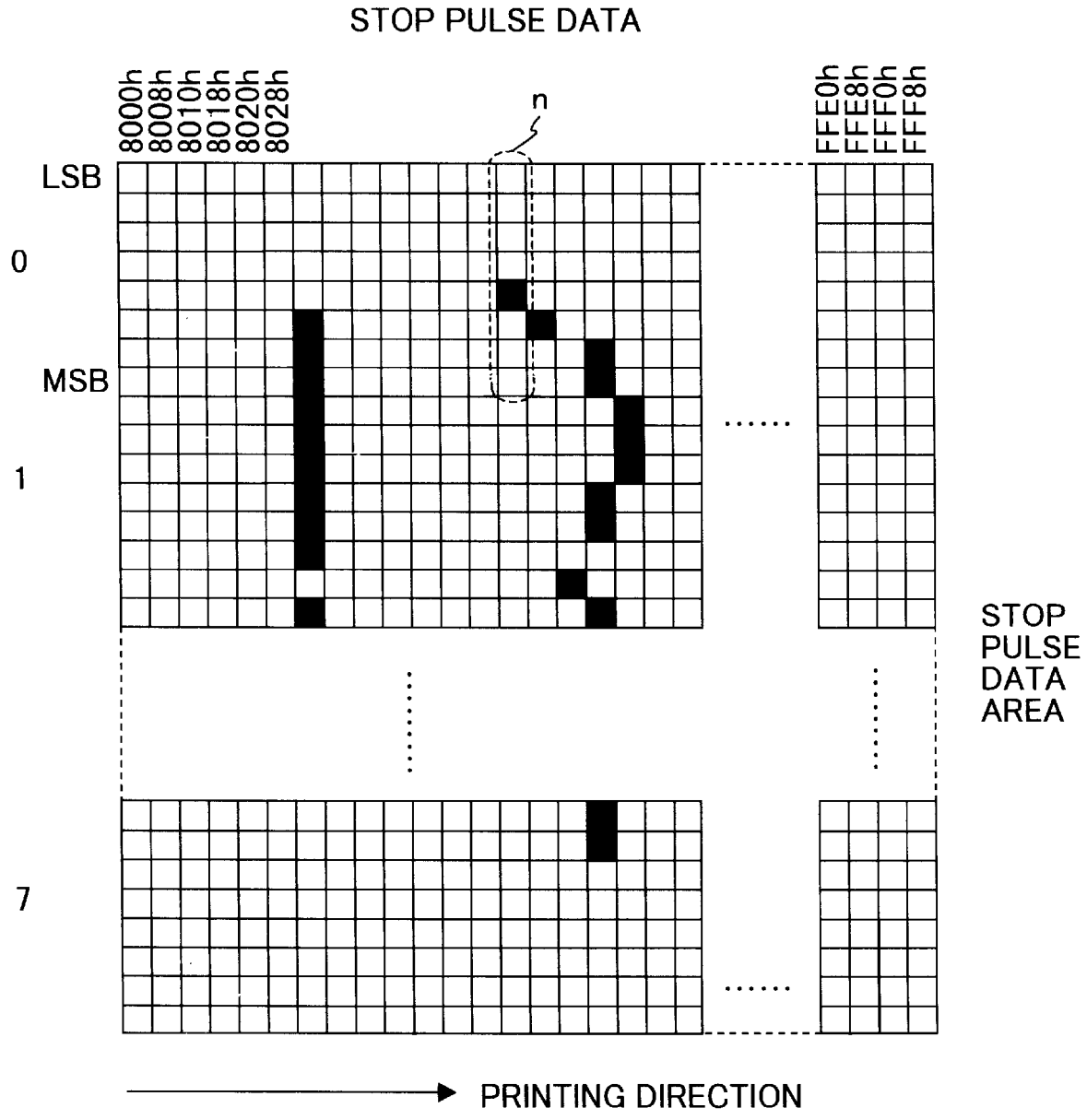
FIG. 22 is an image map of the stop pulse data area in this memory.

FIGS. 21 and 22 are image maps of the print data area 25*a* and the stop pulse data area 25*b*, respectively, of the image memory 25. In FIGS. 21 and 22, black squares represent dots, and white squares represent no dots. Eight bytes (rows 0–7) of print data PD are processed at the same time. As shown in FIG. 21, a byte of print data PDn (B) succeeds a byte of print data PDn−1 (C) and precedes a byte of Print data PDn+1 (A).

Only the stop pulse data control signal SPC3 is made "1" and the other signals SPC0–SPC2 and SPC4–SPC7 are made "0". Consequently, only when a bit of data A is "0" and the associated data B and C are "1", the AND gate 50 (FIG. 4A) associated with it of the stop pulse data generator 56 outputs "1". In other words, an additional stop pulse is generated for a dot (B) following a dot (C) and preceding no dot (A). The stop pulse data SD from the generator 56 are stored in the area 25*b* of the image memory 25. FIG. 22 shows the stop pulse data SD associated with the print data PD shown in FIG. 21.

In accordance with the data transfer control signal, the data transferor 55 read out print data PD and stop pulse data SD from the image memory 25, and outputs them as transfer data TD to the drive circuit.

As shown in FIGS. 7 and 8 for the first embodiment, 64 print data are input in synchronism with the transfer clock TCK to the serial-parallel converter 31 of the drive circuit of this sixth embodiment. The data latch 32 latches the parallel data from the converter 31 in accordance with the strobe signal STB. The AND gates 33 output the logical products of the latched data and the print clock PCK to the output circuits 34. 64 stop pulse data are processed likewise.

Thus, by constructing the control circuit 622 as stated above, and by using a conventional drive circuit, it is possible to provide an ink ejection apparatus which can switch between the execution and no execution of the vibration cancellation.

The invention is not limited to the foregoing embodiments, but various modifications may be made as follows:

(1) In each embodiment, only one print clock pulse is generated for ejection pulse data in each print cycle. Otherwise, two or more print clock pulses might be generated. In this case, the pulses are equal in number to the ink droplets ejected from each channel 613. Therefore, a larger number of print clock pulses for the ejection pulse data result in a larger number of ejected ink droplets. This increases the print density to form a thicker and clearer image.

(2) In each embodiment, the width of the print clock pulses for ejection pulse data is equal to the one-way propagation delay time T. Otherwise, the pulse width might be about an odd number of times as large as the time T.

(3) In each embodiment, the width of the print clock pulses for stop pulse data is half (0.5) of the one-way propagation delay time T. Otherwise, this pulse width might be any other value as far as the pulses can cause the residual pressure wave vibration in the channels 613 to be canceled securely without causing ink to be ejected from the channels.

(4) In each print cycle of each embodiment, the print clock pulse for ejection pulse data falls at a point of time t2 , and the print clock pulse for stop pulse data rises and falls at points of time t3 and t4 , respectively. The time "d" between the point t2 and the middle point tM between the points t3 and t4 is 2.5 times as long as the one-way propagation delay time T. The time "d" might, however, be any other value as far as the residual pressure wave vibration can be canceled securely.

(5) In each embodiment, the output circuits 34 output the same voltage for ink ejection and vibration cancellation. Otherwise, the circuits 34 might output a lower voltage for vibration cancellation than for ink ejection, or a negative voltage.

(6) In each embodiment, the piezoelectric deformation of the upper parts 605 and lower parts 607 of the actuator walls 603 changes the volume of the channels 613 to eject ink. Otherwise, one of the parts 605 and 607 of each actuator wall might be made of material which cannot deform piezoelectrically. In this case, the piezoelectric deformation of the other part 605 or 607 deforms the one part to eject ink.

(7) In each embodiment, the channels 613 alternate with the spaces 615. Otherwise, no spaces 615 might be formed, and the channels 613 might adjoin.

(8) In each embodiment, the invention is applied to the printer in which the print head 600 can reciprocate with the carriage 504. The invention may also be applied to other printers like line printers each of which has a print head fixed to its body.

(9) In each embodiment, the invention is applied to the printer for printing by receiving data from a personal computer. The invention may also be applied to word processors, facsimile machines, etc. into each of which an ink ejection apparatus is incorporated as a printing mechanism.

What is claimed is:

1. An ink droplet ejection apparatus, comprising:

an ink channel which is filled with ink;

an actuator for changing the volume of the ink channel;

a power source for applying electric signals to the actuator; and a controller for causing the power source to apply to the actuator an ejection pulse signal for ejection of ink from the ink channel in accordance with a print command for a dot and an additional pulse signal for substantial cancellation of pressure wave vibration caused in the ink channel by the ejection;

the controller including:

a plurality of storers for storing serial print data therein and outputting the stored data in order;

an additional pulse data generator for making a logical operation based on the data from the storers and an output data combination selection signal to add an additional pulse to an ejection pulse.

2. The apparatus defined in claim 1, wherein the data generator includes logic gate circuits each associated with one of all combinations of the data from the storers, the gate circuits outputting data in accordance with the selection signal.

3. The apparatus defined in claim 1, wherein the selection signal is externally rewritable.

4. The apparatus defined in claim 1, wherein the selection signal is determined depending on temperature or conditions of use, the data generator including a logical circuit for receiving the print data from the storers and the selection signal and for making a logical operation.

5. The apparatus defined in claim 1, wherein the ink channel includes a plurality of channels, the actuator including actuators each associated with one of the channels;

the apparatus further comprising an image memory for storing therein print data for the respective channels;

the storers including:

a serializer for holding the print data transferred in parallel from the memory, and outputting the held data in series to make a parallel-serial conversion of the print data;

a first shift register for receiving the print data output in series from the serializer, shifting the received data therein, and outputting in series the print data stored therein; and a second shift register for receiving the print data output in series from the first shift register, shifting the received data therein, and outputting in series the print data stored therein;

the serializer outputting the data for a cycle following a certain cycle when the first shift register outputs the data for the certain cycle;

the second shift register outputting the data for a cycle preceding the certain cycle when the first shift register outputs the print data for the certain cycle;

the data generator making a logical operation based on the data output for each of the channels from the serializer and the first and second shift registers.

6. An ink droplet ejection apparatus, comprising:

an ink channel which is filled with ink;

an actuator for changing the volume of the channel;

a power source for applying electric signals to the actuator; and a controller for causing the power source to apply to the actuator an ejection pulse signal for ejection of ink from the ink channel in accordance with a print command for a dot and an additional pulse signal for substantial cancellation of pressure wave vibration caused in the ink channel by the ejection;

the controller including:

three storers for storing serial print data therein and transferring the stored data in order; and a logical operator for making a logical operation based on the print data stored in the storers, and determining whether an additional pulse should be generated.

7. The apparatus defined in claim 6, wherein the ink channel includes a plurality of channels, the actuator including actuators each associated with one of the channels;

the apparatus further comprising an image memory for storing therein print data for the respective channels;

the storers including:

a serializer for holding the print data transferred in parallel from the memory, and outputting the held data in series to make a parallel-serial conversion of the print data;

a first shift register for receiving the print data output in series from the serializer, shifting the received data therein, and outputting in series the print data stored therein; and a second shift register for receiving the print data output in series from the first register, shifting the received data therein, and outputting in series the print data stored therein;

the serializer outputting the print data for a cycle following a certain cycle when the first shift register outputs the print data for the certain cycle;

the second register outputting the print data for a cycle preceding the certain cycle when the first register outputs the print data for the certain cycle;

the logical operator making a logical operation based on the print data output for each of the channels from the serializer and the first and second shift registers.

8. The apparatus defined in claim 7, wherein each cycle includes a first period and a second period following the first period, the controller transferring an ejection pulse signal and an additional pulse signal in the first and second periods, respectively.

9. The apparatus defined in claim 6, wherein the logical operation is based on the print data from the storers and a selection signal determined depending on temperature or conditions of use.

10. The apparatus defined in claim 7, wherein the controller includes:

a gate array, which includes the serializer, the shift registers and the logical operator; and a drive circuit for driving the actuators with the output from the gate array.

11. The apparatus defined in claim 6, wherein the controller further includes: a first serial-parallel converter for receiving the print data output in series from one of the storers, and for converting the serial print data into parallel data;

a second serial-parallel converter for receiving the additional pulse data output in series from the logical operator, and for converting the serial pulse data into parallel data; and a switch for switching the output from the two converters cyclically.

12. The apparatus defined in claim 11, wherein the controller includes:

a gate array, which includes the serializer, the shift registers and the logical operator; and a drive circuit for driving the actuator in accordance with the output for switching the drive circuit including the first and second serial-parallel converters and the switch.

13. An ink droplet ejection apparatus comprising:

a plurality of channels which are filled with ink;

actuators each for changing the volume of one of the channels;

a memory for storing therein print data for driving the respective actuators;

a controller for transferring in series the print data from the memory;

a first serial-parallel converter for holding the transferred serial data and outputting the held data in parallel and series;

a second serial-parallel converter for holding the data transferred in series from the first converter, and outputting the held data in parallel and series;

a third serial-parallel converter for holding the data transferred in series from the second converter, and outputting the held data in parallel and series;

the first converter outputting the data in parallel for a cycle following a certain cycle when the second converter outputs the data in parallel for the certain cycle;

the third converter outputting the data in parallel for a cycle preceding the certain cycle when the second converter outputs the data in parallel for the certain cycle; and a logical operator for generating an additional pulse data bit for each of the channels for the certain cycle by making a logical operation based on the data output for the channel from the three converters;

whereby an ejection pulse signal based on the print data for ejection of ink from each of the channels in accordance with a print command for a dot and the signal output from the operator for substantial cancellation of pressure wave vibration caused in the channel by the ejection are applied to the associated actuator.

14. The apparatus defined in claim 13, wherein the actuators, the three serial-parallel converters and the logical operator are formed on a carriage for moving the ink droplet ejection apparatus along a printing medium.

15. An ink droplet ejection apparatus, comprising:

a channel which is filled with ink;

an actuator for changing the volume of the channel;

a power source for applying electric signals to the actuator;

a controller for causing the power source to apply to the actuator an ejection pulse signal for ejection of ink from the channel in accordance with a print command for a dot and an additional pulse signal for substantial cancellation of pressure wave vibration caused in the channel by the ejection; and an image memory for storing therein a series of print data for ejecting ink from the channel;

the controller including:

three storers for storing therein and transferring in order the print data stored in the memory;

a logical operator for generating the additional pulse by making a logical operation based on the print data stored for three consecutive data in the storers, the operator storing the generated additional pulse in the memory; and a transferor for transferring to the actuator the print data and the additional pulse data stored in the memory.

16. The apparatus defined in claim 15, wherein the storers include first, second and third registers for holding the print data transferred from the image memory, the second register holding the print data for a certain cycle;

the first register holding, when the second register holds the print data for the certain cycle, the print data for a cycle following the certain cycle; and the third register holding, when the second register holds the print data for the certain cycle, the print data for a cycle preceding the certain cycle;

the logical operator making a logical operation based on the print data from the first, second and third registers.

17. The apparatus defined in claim 15, wherein the logical operation is based on the print data from the storers and a selection signal determined depending on temperature or conditions of use.

18. The apparatus defined in claim 16, wherein the controller includes:

a gate array, which includes the three registers and the logical operator; and a drive circuit for driving the actuator with the output from the array.

19. An ink jet recorder, comprising:

an ink jet head including an ink channel which is filled with ink, and an actuator for changing the volume of the ink channel;

a power source for applying electric signals to the actuator; and a controller for causing the power source to apply to the actuator an ejection pulse signal for ejection of ink from the ink channel in accordance with a print command for a dot and an additional pulse signal for substantial cancellation of pressure wave vibration caused in the ink channel by the ejection;

the controller including:

a plurality of storers for storing serial print data therein and outputting the stored data in order;

an additional pulse data generator for making a logical operation based on the data from the storers and an output data combination selection signal to add an additional pulse to an ejection pulse.

20. An ink jet recorder comprising:

an ink jet head including an ink channel which is filled with ink, and an actuator for changing the volume of the channel;

a power source for applying electric signals to the actuator; and a controller for causing the source to apply to the actuator an ejection pulse signal for ejection of ink from the ink channel in accordance with a print command for a dot and an additional pulse signal for substantial cancellation of pressure wave vibration caused in the ink channel by the ejection;

the controller including:

three storers for storing serial print data therein and transferring the stored data in order; and a logical operator for making a logical operation based on the print data stored in the storers, and determining whether an additional pulse should be generated.

21. An ink jet recorder comprising:

an ink jet head including a plurality of channels which are filled with ink, and actuators each for changing the volume of one of the channels;

a memory for storing therein print data for driving the respective actuators;

a controller for transferring in series the print data from the memory;

a first serial-parallel converter for holding the transferred serial data and outputting the held data in parallel and series;

a second serial-parallel converter for holding the data transferred in series from the first converter, and outputting the held data in parallel and series;

a third serial-parallel converter for holding the data transferred in series from the second converter, and outputting the held data in parallel and series;

the first converter outputting the data in parallel for a cycle following a certain cycle when the second converter outputs the data in parallel for the certain cycle;

the third converter outputting the data in parallel for a cycle preceding the certain cycle when the second converter outputs the data in parallel for the certain cycle; and a logical operator for generating an additional pulse data bit for each of the channels for the certain cycle by making a logical operation based on the data output for the channel from the three converters;

whereby an ejection pulse signal based on the print data for ejection of ink from each of the channels in accordance with a print command for a dot and the signal output from the operator for substantial cancellation of pressure wave vibration caused in the channel by the ejection are applied to the associated actuator.

22. An ink jet recorder, comprising:

an ink jet head including a channel which is filled with ink, and an actuator for changing the volume of the channel;

a power source for applying electric signals to the actuator;

a controller for causing the power source to apply to the actuator an ejection pulse signal for ejection of ink from the ink channel in accordance with a print command for a dot and an additional pulse signal for substantial cancellation of pressure wave vibration caused in the channel by the ejection; and an image memory for storing therein a series of print data for ejecting ink from the channel;

the controller including:

three storers for storing therein and transferring in order the print data stored in the memory;

a logical operator for generating the additional pulse by making a logical operation based on the print data stored for three consecutive data in the storers, the operator storing the generated additional pulse in the memory; and a transferor for transferring to the actuator the print data and the additional pulse data stored in the memory.

* * * * *

UNITED STATES PATENT AND TRADEMARK OFFICE

CERTIFICATE OF CORRECTION

PATENT NO. : 6,299,271 B1
DATED : October 9, 2001
INVENTOR(S) : Koji Imai

It is certified that error appears in the above-identified patent and that said Letters Patent is hereby corrected as shown below:

Title page,
Item [30], please replace with the following:
-- [30] Foreign Application Priority Data

| | | |
|---|---|---|
| Mar. 31, 1998 | (JP) ..... | 10-087524 |
| Apr. 6, 1998 | (JP) ..... | 10-093762 |
| Apr. 6, 1998 | (JP) ..... | 10-093763 |
| Apr. 6, 1998 | (JP) ..... | 10-093764 |
| Apr. 9, 1998 | (JP) ..... | 10-097794 |
| Jan. 28, 1999 | (JP) ..... | 11-019946 -- |

Signed and Sealed this

Twentieth Day of August, 2002

*Attest:*

*Attesting Officer*

JAMES E. ROGAN
*Director of the United States Patent and Trademark Office*